US006993480B1

(12) United States Patent
Klayman

(10) Patent No.: US 6,993,480 B1
(45) **Date of Patent: *Jan. 31, 2006**

(54) VOICE INTELLIGIBILITY ENHANCEMENT SYSTEM

(75) Inventor: Arnold I. Klayman, Huntington Beach, CA (US)

(73) Assignee: SRS Labs, Inc., Santa Clara, CA (US)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 09/185,876

(22) Filed: Nov. 3, 1998

(51) Int. Cl.
*G10L 21/02* (2006.01)

(52) U.S. Cl. ..... 704/226; 704/225

(58) Field of Classification Search ..... 704/500, 704/501, 201, 203, 226–228
See application file for complete search history.

(56) References Cited

U.S. PATENT DOCUMENTS

| | | | | |
|---|---|---|---|---|
| 3,180,938 | A | | 4/1965 | Schroeder |
| 3,838,217 | A | | 9/1974 | Dreyfus |
| 4,090,033 | A | | 5/1978 | Silverstein |
| 4,166,926 | A | | 9/1979 | Sieler |
| 4,186,280 | A | | 1/1980 | Geiseler |
| 4,275,269 | A | | 6/1981 | Sugita et al. |
| 4,287,391 | A | | 9/1981 | Queen |
| 4,340,779 | A | | 7/1982 | Hashimoto et al. |
| 4,441,202 | A | | 4/1984 | Tong et al. |
| 4,506,379 | A | | 3/1985 | Komatsu |
| 4,542,524 | A | | 9/1985 | Laine |
| 4,618,985 | A | | 10/1986 | Pfeiffer |
| 4,622,692 | A | * | 11/1986 | Cole ..... 381/94.3 |
| 4,630,304 | A | * | 12/1986 | Borth et al. ..... 381/94.3 |
| 4,641,343 | A | | 2/1987 | Holland et al. |
| 4,661,981 | A | | 4/1987 | Henrickson et al. |
| 4,696,040 | A | | 9/1987 | Doddington et al. |
| 4,703,505 | A | | 10/1987 | Seiler et al. |
| 4,707,858 | A | | 11/1987 | Fette |
| 4,743,906 | A | | 5/1988 | Fullerton |
| 4,748,669 | A | | 5/1988 | Klayman |
| 4,802,228 | A | | 1/1989 | Silverstein et al. |

(Continued)

FOREIGN PATENT DOCUMENTS

BE 674341 12/1965

(Continued)

OTHER PUBLICATIONS

Coetzee, et al., "An LSP Based Speech Quality Measure", ICASSP-89, pp. 596-599, vol. 1, May 1989, no day.

(Continued)

*Primary Examiner*—W. R. Young
*Assistant Examiner*—Michael N. Opsasnick
(74) *Attorney, Agent, or Firm*—Knobbe, Martens, Olson & Bear LLP

(57) ABSTRACT

Intelligibility of a human voice projected by a loudspeaker in an environment of high ambient noise is enhanced by processing a voice signal in accordance with the frequency response characteristics of the human hearing system. Intelligibility of the human voice is derived largely from the pattern of frequency distribution of voice sounds, such as formants, as perceived by the human hearing system. Intelligibility of speech in a voice signal is enhanced by filtering and expanding the voice signal with a transfer function that approximates an inverse of equal loudness contours for tones in a frontal sound field for humans of average hearing acuity.

62 Claims, 19 Drawing Sheets

U.S. PATENT DOCUMENTS

| | | | | |
|---|---|---|---|---|
| 4,819,269 | A | 4/1989 | Klayman | |
| 4,827,516 | A | 5/1989 | Tsukahara et al. | |
| 4,829,572 | A | 5/1989 | Kong | |
| 4,836,329 | A | 6/1989 | Klayman | |
| 4,841,572 | A | 6/1989 | Klayman | |
| 4,852,172 | A | 7/1989 | Taguchi | |
| 4,866,774 | A | 9/1989 | Klayman | |
| 4,882,752 | A | 11/1989 | Lindman et al. | |
| 4,882,758 | A | 11/1989 | Uekawa et al. | |
| 4,896,360 | A | 1/1990 | Knight | |
| 4,922,539 | A | 5/1990 | Rajasekaran et al. | |
| 4,933,973 | A | 6/1990 | Porter | |
| 4,945,568 | A | 7/1990 | Willems | |
| 4,969,192 | A | 11/1990 | Chen et al. | |
| 4,979,216 | A | 12/1990 | Malsheen et al. | |
| 5,012,519 | A | 4/1991 | Adlersberg et al. | |
| 5,058,169 | A | 10/1991 | Temmer | |
| 5,103,481 | A | 4/1992 | Iseda et al. | |
| 5,133,013 | A | 7/1992 | Munday | |
| 5,148,488 | A | 9/1992 | Chen et al. | |
| 5,150,413 | A | 9/1992 | Nakatani et al. | |
| 5,175,793 | A | 12/1992 | Sakamoto et al. | |
| 5,177,329 | A | 1/1993 | Klayman | |
| 5,181,251 | A | 1/1993 | Schultheiss et al. | |
| 5,195,167 | A | 3/1993 | Bahl et al. | |
| 5,216,718 | A | 6/1993 | Fukuda | |
| 5,243,656 | A | 9/1993 | Tanida et al. | |
| 5,251,260 | A | 10/1993 | Gates | |
| 5,280,543 | A | 1/1994 | Yokoyama et al. | |
| 5,319,713 | A | 6/1994 | Waller, Jr. et al. | |
| 5,333,201 | A | 7/1994 | Waller, Jr. | |
| 5,426,719 | A * | 6/1995 | Franks et al. | 704/228 |
| 5,459,813 | A | 10/1995 | Klayman | |
| 5,550,924 | A * | 8/1996 | Helf et al. | 381/94.3 |
| 5,638,452 | A | 6/1997 | Waller, Jr. | |
| 5,661,808 | A | 8/1997 | Klayman | |
| 5,771,295 | A | 6/1998 | Waller, Jr. | |
| 5,784,468 | A | 7/1998 | Klayman | |
| 5,850,453 | A | 12/1998 | Klayman et al. | |
| 5,953,697 | A * | 9/1999 | Lin et al. | 704/225 |

FOREIGN PATENT DOCUMENTS

| | | |
|---|---|---|
| DE | 2555263 | 2/1977 |
| JP | 64-49100 | 2/1989 |

OTHER PUBLICATIONS

Lim, "Enhancement and Bandwidth Compression of Noisy Speech", *Proceedings of the IEEE*, vol. 67, No. 12, pp. 1586-1604, Dec. 1979, no day.

Conway, et al., "Evaluation of a Technique Involving Processing With Feature Extraction to Enhance the Intelligibility of Noise-Corrupted Speech", IECON '90 Conference of IEEE Industrial Electronics Society, vol. 1, pp. 28-33, Nov. 27-30, 1990.

Conway, et al., "Adaptive Postfiltering Applied to Speech in Noise", Midwest Symposium on Circuits and Systems, pp. 101-104, Aug. 1989, no day.

Clarkson, et al., "Envelope Expansion Methods for Speech Enhancement", *J. Acoust. Soc. Am.*, vol. 89, No. 3, pp. 1378-1382, Mar. 1991, no day.

* cited by examiner

VOICE INTELLIGIBILITY ENHANCEMENT SYSTEM

BACKGROUND OF THE INVENTION

1. Field of the Invention

The present invention relates to intelligible reproduction of human speech or voice sounds, and more particularly, relates to systems for improving the intelligibility of voice sounds or signals that are degraded in some fashion, such as degradation caused by noise.

2. Description of the Related Art

Speech reproduction systems, such as public address systems, telephones, cellular telephones, two-way radios, broadcast radios, etc., are often used in environments where the listener hears the speech signal combined with noise. In some circumstances the noise is of such a level that intelligibility of the desired spoken communication from the speech reproduction system is greatly degraded.

A typical speech reproduction system includes a signal source that generates a speech signal, a loudspeaker, and a transmission system that carries the speech signal from the source to the loudspeaker. Typical signal sources include microphone, tape playback units, audio units, computer speech generators, etc. The types of noise in a typical speech reproduction system can be loosely categorized into three general groups based on the point where the noise enters the system, the noise groups include: source noise, transmission noise, and ambient noise. Source noise is noise introduced at the source. Wind noise in a microphone is an example of source noise. Transmission noise is noise introduced by the transmission system, that is, noise introduced between the source and the loudspeaker. A common example of transmission noise is the static that is sometimes heard in a telephone, cellular telephone, or radio broadcast. Ambient noise is noise present in the listener's environment, that is, acoustic noise that the listener hears in addition to the sounds from the loudspeaker. For example, the background noise heard in a noisy environment such as an airport or automobile is ambient noise.

There are many environments of this type where communication is lost, or at least partly lost, because the ambient noise level masks or distorts the speaker's voice, as it is heard by the listener. These environments include airports, subway, bus and railroad terminals, aircraft and trains, aircraft carriers, landing craft, helicopters, dock facilities, cars and other vehicles, and other noisy places. Few people who have attempted to understand a public announcement or use a telephone in a noisy airport can fail to appreciate the difficulty of extracting useful information in the presence of such ambient noise.

Attempts to minimize loss of intelligibility in the presence of noise have involved use of equalizers, clipping circuits, or simply increasing the volume of the sound from the loudspeaker system. Equalizers and clipping circuits may themselves increase the overall noise level, and thus fail to solve the problem. Simply increasing the overall level of sound from the loudspeaker does not significantly improve intelligibility and often causes other problems such as feedback and listener discomfort.

SUMMARY OF THE INVENTION

The present invention solves these and other problems by providing improved intelligibility of voice communication that would otherwise be degraded by noise. In one embodiment, intelligibility of speech is improved by a speech enhancer that uses an aural filter in combination with a speech expander. The speech enhancer also improves the intelligibility of speech that is degraded by factors other than noise, such as, for example, speech that is mumbled.

The speech enhancer provides a transfer function that approximates the inverse (or compliment) of the Fletcher-Munson (F-M) curves. The F-M curves quantify the way in which the human hearing system, particularly the ear, processes sounds. As demonstrated by the F-M curves, the frequency response of the human hearing system is non-linear. The human hearing system favors the middle frequency sounds over low frequency and high frequency sounds. When the sounds are relatively quiet (e.g., low volume levels) the hearing system strongly favors middle frequency sounds. As the sound increases in volume, the frequency response of the hearing system becomes flatter (e.g., more uniform) and the middle frequency sounds are not favored as much.

The input signal to the speech enhancer is typically a speech signal, such as, for example, the signal from a microphone, tape deck, CD player, etc. When the speech signal is operating at a low volume level, the speech enhancer provides a transfer function that is relatively flatter than the transfer function at high volume levels. For example, when an announcer speaking into the microphone is talking very quietly, more of the low and high frequency components of the announcer's voice are provided to the listener. This provides the listener with more information in order to help the listener understand the words. Conversely, when the speech signal is operating at high volume levels, the speech enhancer provides a transfer function that produces relatively more gain in the middle frequency ranges than in the low and high frequency ranges. Intelligibility of the speech is enhanced because it is the middle frequencies that contribute most to the intelligibility of speech. At higher volume levels, the lower and higher frequencies merely contribute to the overall sound volume level and thus tend to increase listener discomfort and feedback rather than intelligibility.

Stated differently, the speech enhancer provides a transfer function that is in many respects, complementary to the transfer function of the human hearing system. By providing a complementary transfer function, the speech enhancer improves intelligibility, and listener comfort, by reducing the relative volume level of sounds that do not contribute to (or even reduce) speech intelligibility. The speech enhancer may advantageously be used in or in connection with: public address systems; hearing aids; communication devices, including telephones and cellular telephones; audio processors for improving clarity and/or intelligibility of music, speech or the spoken word; apparatus for use in processing audio electronic signals consisting primarily of speech to improve intelligibility and/or clarity; integrated circuits; video monitors; video tuners; stereo receivers and amplifiers; tape decks; car stereos; televisions; portable stereos; boomboxes; stereo processors for use in cinemas; video disc playback and/or recording apparatus; audio playback and/or recording apparatus; home audio-visual recording apparatus; laser disc players and records; VCRs; digital versatile disk (DVD) players; digital video tape players; speakers; speaker systems containing a sound transducer and an integral amplifier; CD (compact disc) playback and/or recording devices; motion picture projectors; cable television receivers and decoders; remote control units for these goods; computer programs having sound generating capability; computer software for expanding an audio image generated by speakers for use in the entertainment field;

computers; computer sound processing cards; industry standard computer interface cards; computer audio processing circuitry; computer hardware, namely computer diskettes, computer floppy disks, hard discs, CD-ROM discs, digital video discs, optical storage discs, and computer solid-state cartridges; audio and/or audio-visual recordings stored on magnetic tape or optical media; audio and/or audio-visual prerecorded media containing entertainment material in the form of the spoken word, music and other sounds, namely motion picture film, VCR cassette tapes, laser discs, video discs, optical discs analog or digital audio cassette tapes, and analog or digital video cassette tapes; and the like.

One embodiment provides for enhancing the intelligibility of voice information, such as spoken words, recorded speech, synthesized speech, and the like, projected into an area of ambient noise from a loudspeaker system that receives an input signal derived from an electrical voice signal representing spoken words. The electrical voice signal may come from a microphone, a playback device, a receiver, etc. For convenience, the voice signal is described herein as an electrical signal with the understanding that the electrical voice signal may also be embodied as a sequence of digital values, as in a computer or digital signal processor. The electrical signal is provided to an aural filter that provides relatively less attenuation of middle (e.g., speech) frequencies of the electrical signal and relatively more attenuation of other frequencies. The filtered signal is provided to a voice expander having a varying gain.

The gain of the expander is varied according to some property of the filtered signal. For example, the gain of the expander may be varied according to the envelope of the filtered signal, the average power in the filtered signal, the average Root Mean Square (RMS) value of the filtered signal, the average peak value of the filtered signal, etc. An output of the voice expander is combined with the electrical voice signal to produce an enhanced voice signal. The enhanced voice signal is amplified and may then be provided to one or more loudspeakers to be projected as sound into an area of ambient noise. Alternatively, the enhanced voice signal may be provided to a recording device and recorded for later playback. The enhanced voice signal may also be provided to a loudspeaker in a communications device, such as, for example, a telephone, cellular telephone, cordless telephone, radio, or other communications receiver.

BRIEF DESCRIPTION OF THE DRAWINGS

The advantages and features of the disclosed invention will readily be appreciated by persons skilled in the art from the following detailed description when read in conjunction with the drawings listed below.

Figure 1A:
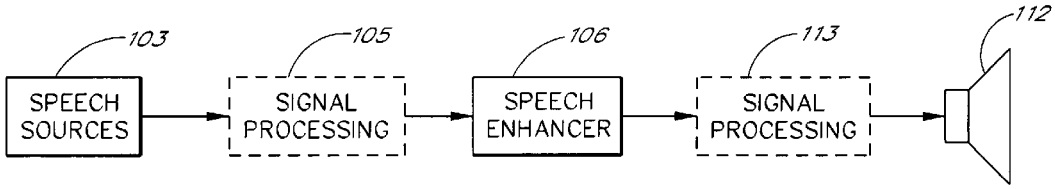
FIG. 1A is a block diagram of a system that includes speech enhancement.

In the drawings, the first digit of any three-digit number generally indicates the number of the figure in which the element first appears. Where four-digit reference numbers are used, the first two digits indicate the figure number.

DETAILED DESCRIPTION

FIG. 1A illustrates a generic system having a speech enhancer 106. Speech signals are provided by a speech source 103. The speech source 103 is any device that provides a speech signal, such as an analog signal or a digital data stream. The speech source 103 includes, for example, a person talking into a microphone or a speech generating device such as a computer speech program. An output of the speech source 103 is provided to an input of an optional signal processing block 105. An output of the signal processing block 105 is provided to an input of the speech enhancer 106. An output of the speech enhancer 106 is provided to an input of an optional signal processing block 113. An output of the optional signal processing block 113 is provided to a loudspeaker 112.

The optional signal processing blocks 105 and 113 represent the signal processing and transmission operations normally performed on the speech signal as the signal travels from the source 103 to the loudspeaker 112. Typical operations performed in the optional signal processing bocks 105 and/or 113 may include, for example, filtering, amplification, gain control, feedback cancellation, mixing, transmission, storage, playback, reception, encoding, decoding, noise canceling, up-conversion, down-conversion, detection, modulation, etc. The loudspeaker 112 is any device that converts the speech signal into an acoustic signal, including, for example, a cone-type loudspeaker, a horn-type loudspeaker, an earphone, a headset, a telephone handset loudspeaker, a speakerphone loudspeaker, an impedance transformer, etc.

Figure 1B:
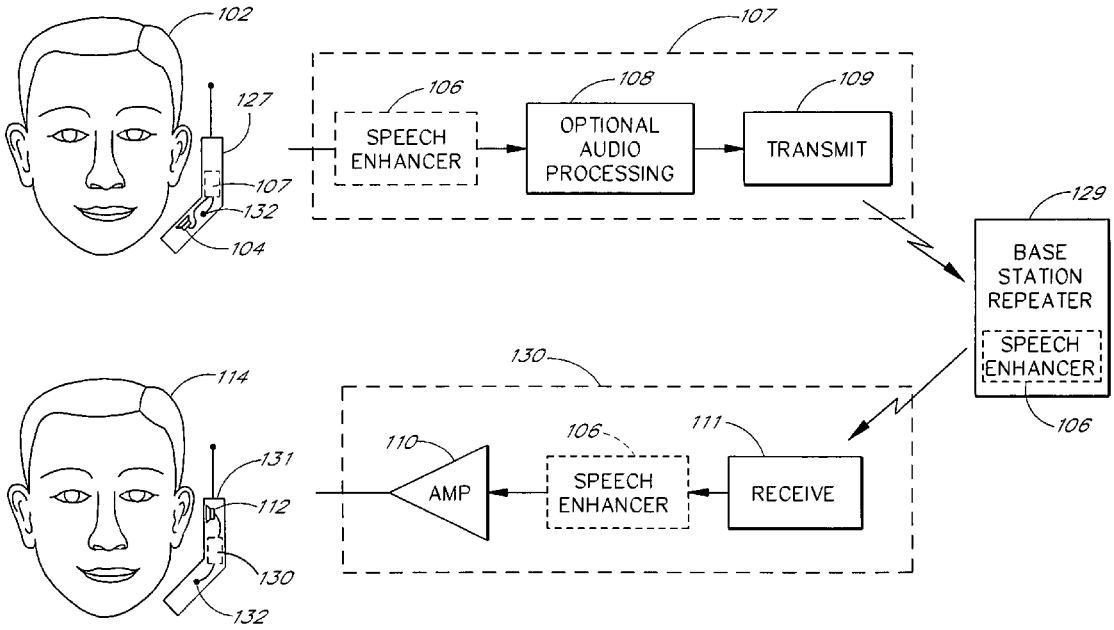
FIG. 1B is a block diagram of an audio system, such as a cellular telephone system, that provides enhanced speech from a transmission or recording medium.

FIG. 1B is a block diagram that illustrates the speech enhancer 106 in a communication system or a recording/playback system. Communication systems include, for example, telephones, cellular telephones, cordless telephones, satellite systems (including the IRIDIUM system), spread-spectrum radios, two-way radios, walkie-talkies, marine radios, HAM radios, aircraft radios, broadcast radios, shortwave radios, Citizen's Band (CB) radios, dispatch radios (e.g., for taxicab and truck drivers), police radios, military communications systems including VHF, frequency-hopping, and spread-spectrum systems, intercom systems, video-conferencing systems, optical networks, and computer networks (including the Internet).

In FIG. 1B, the source 103 comprises a person (announcer) 102 speaking into a microphone 104. The microphone 104 may be located, for example, in a telephone, cellular telephone, cordless telephone, cockpit voice recorder, radio, tape recorder, computer, etc. In FIG. 1B, the microphone is shown located in a cellular or cordless telephone handset 127 comprising the microphone 104 and a transceiver (transmitter/receiver) that includes a sender such as a transmitting system 107. The transmitting system 107 sends information over a communication channel. The transmitting system 107 comprises an optional speech enhancer 106, an optional audio processing block 108 and a transmitting device 109. The output of the microphone 104 is provided to the speech enhancer 106 and the output of the speech enhancer 106 is provided to an input of an optional audio-processing block 108. The output of the optional audio-processing block 108 is provided to an input of a transmitter (or recording) device 109.

An output from the transmitting device 109 is provided to an input of a repeater 129 (e.g., a cellular telephone tower, a base station, a satellite, etc.). An output of the repeater 129 is provided to an input of a receiving (or playback) device 111. An output of the receiving device 111 is provided to the input of an optional speech enhancer 106. An output of the speech enhancer 106 is provided to an input of an amplifier 110 and an output of the amplifier 110 is provided to the loudspeaker 112. The receiving device 111, speech enhancer 106, and the amplifier 110 are shown as elements of a transceiver that includes a receiving system 130 located in a telephone handset 131. An optional user control 132 is provided to allow the user 114 to control the operation of the speech enhancer 106. The control 132 may include, for example, a switch, a button, a thumb control, a menu item, etc. In some embodiments, the control 132 is used to enable and disable the speech enhancer 106. In some embodiments, the control 132 is used to control the amount of enhancement provided by the speech enhancer 106.

The speech enhancer 106 is interposed anywhere in the signal path between the microphone 104 and the loudspeaker 112. Thus, for example, the speech enhancer 106 may be provided in the transmitter system 107 as shown, in the base station 129 as shown, or in the receiver system 130 as shown.

The transmitting/recording device 109 may be a radio transmitter (e.g., a microwave transmitter in a telephone or cellular telephone system), optical transmitter, fiber-optic transmitter, acoustic transmitter etc., that converts the voice signals into signals that propagate in a transmission medium to the receiving device 111. The repeater 129 is typical of many communications system. However, is some applications, such as, for example, walkie-talkies or other two-way radios, the repeater 129 is sometimes omitted.

Alternatively, the transmitting/recording device 109 may be a recording device configured to record on a storage media, and the receiving/playback device 111 is configured to retrieve data from the storage media. Typical storage media includes magnetic tape, optical disks, computer disks, film, compact disks, magneto-optical disks, solid-state memories, bubble memories, etc.

Figure 1C:
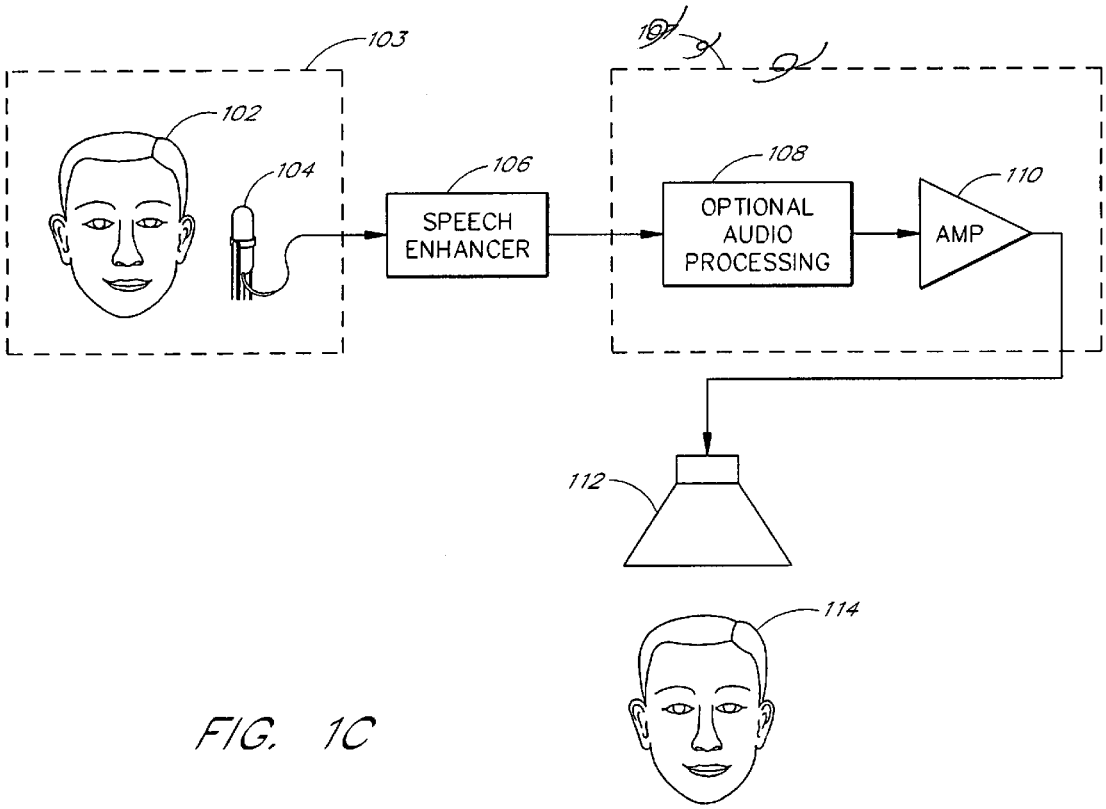
FIG. 1C is a block diagram of an audio system, such as a public address system, that provides enhanced speech from a loudspeaker system.

FIG. 1C illustrates the basic components of a typical public address system having a speech enhancer 106. FIG. 1C shows the source 103 comprising the announcer 102 speaking into the microphone 104. The microphone 104 converts the speech sounds into electrical speech signals and provides the electrical speech signals to the speech enhancer 106. One skilled in the art will recognize that one or more amplifiers, often called pre-amplifiers, may be provided between the output of the microphone 104 and the input of the speech enhancer 106 in order to amplify the weak electrical signals provided by the microphone 104. An output of the speech enhancer 106 is provided to an input of the optional audio-processing block 108. The processing block 108 may provide, for example, feedback suppression, long distance distribution systems such as line-transformers or repeaters, etc. An output of the processing block 108 is provided to an input of the amplifier 110. The optional audio-processing block 108 may also be omitted, in which case, the output of the speech enhancer 106 is provided directly to the input of the amplifier 110. An output of the amplifier 110 is provided to the loudspeaker 112.

The speech enhancer 106 modifies the electrical signals provided by the microphone 104 such that the voice sounds projected by the loudspeaker system 112 have enhanced intelligibility, even in the presence of noise. The loudspeaker may be located to project sound in a listener area to be heard by one or more listeners. The listener area may be, for example, a home, an office (e.g., from an office PA system or a speaker-phone), an auditorium, an airplane cabin, an airport, a stadium, a shopping center, a fairground, etc.

In one embodiment, the speech enhancer 106 takes advantage of the manner in which human speech is generated, heard, and processed by the individual human ear and brain. The speech enhancer 106 enhances vocal sounds, including, for example, formants of vowels, consonants, fricatives and plosives according to the way in which the human ear hears and perceives speech sounds, such that the enhanced vocal sounds provide a speech signal of increased intelligibility.

A brief description of mechanics of speech generation and comprehension will help to explain some aspects of the present invention. Human speech is produced by generating sounds in the vocal tract. The vocal tract causes these sounds to resonate at different frequencies. Vowels are generated by an air stream expelled from the lungs to cause vibration of the human vocal folds, generally known as vocal cords. Sound generated by vibration of the vocal cords is composed of a fundamental frequency or base band and many harmonic partials or overtones, at successively higher frequencies. Amplitudes of the harmonics decrease with increasing frequency at a rate of about 12 decibels per octave. The baseband, or fundamental frequency, and its overtones pass through the vocal tract, which includes various cavities within the throat, head and mouth that provide a plurality of individual resonances. The vocal tract has a plurality of characteristic modes of resonance and to some extent acts as a plurality of resonators operating on the base band or fundamental frequency and its overtones. Because of the selective resonating action of the vocal tract, amplitudes of the several partials of the fundamental frequency of the vocal cords do not decrease in a smooth curve with increasing frequency, but exhibit sharp peaks at frequencies corresponding to the particular resonances of the vocal tract. These peaks or resonances are termed "formants".

Figure 2:
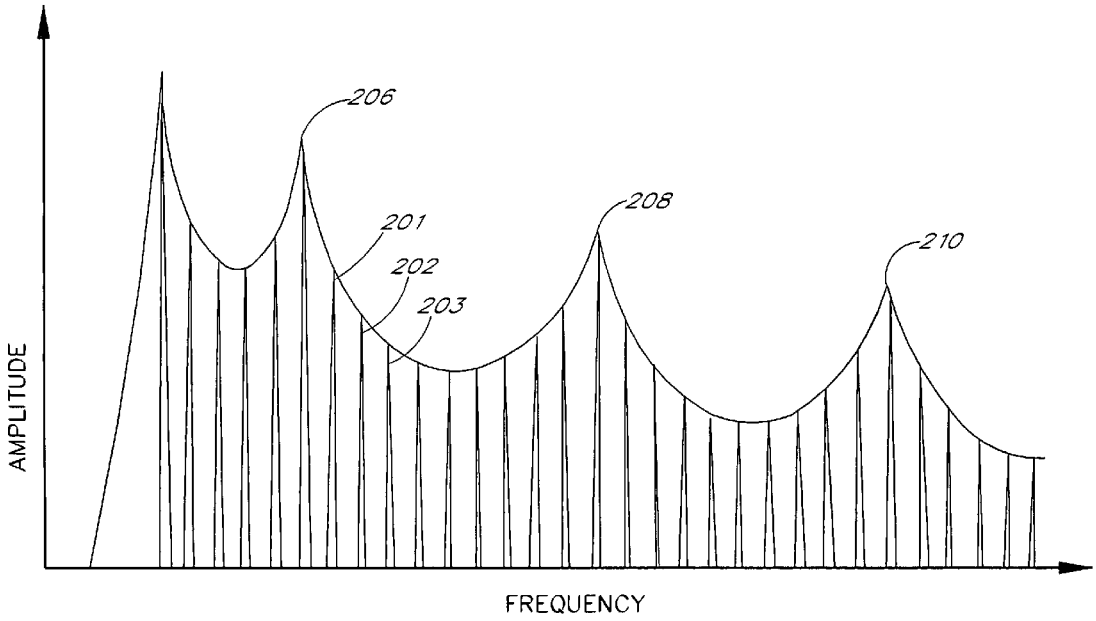
FIG. 2 is a frequency-domain plot of the spectrum response of typical human speech.

FIG. 2 is a frequency-domain graph of a voiced sound (e.g. a vowel), plotting amplitude against frequency of a number of harmonics. At the left side of the graph, at the lowest frequency, is the fundamental frequency or base band caused by vibration of the vocal cords. This base band frequency is typically between about 60 and 250 hertz for a typical adult male voice. The many harmonics of the fundamental frequency are indicated by the individual components, such as the components 201, 202, and 203 shown in FIG. 2. It can be seen that the entire voice signal is made up of the base band and a large number of individual harmonics over the entire frequency band. The frequency band of interest in voice signals is generally between about 60 and about 7,500 Hz (Hertz).

FIG. 2 illustrates the fact that the individual harmonics, which have amplitudes that naturally decrease with increasing frequency, do not decrease in amplitude in a smooth curve, but rather exhibit certain peaks, such as those indicated at 206, 208, and 210. These peaks represent the individual resonances of the vocal tract and are illustrated for purposes of exposition as being three in number, although there may be as many as four, five or more in an ordinary human vocal tract. These peaks, or vocal tract resonances, are the formants of the spoken voice. In an adult male the first four (lower frequency) formants are typically close to about 500, 1500, 2500 and 3500 hertz, respectively.

Moving the various articulatory organs (including the jaw, the body of the tongue, the tip of the tongue) changes frequency of the several formants over a wide range. Different formant frequencies have different sensitivities to shape or position of individual articulatory organs. It is the selected movement of these organs that each human speaker employs to give voice to a selected speech sound. Conversely, when listening to spoken words each speech sound can be recognized, in part, by its set of formants.

Normal human speech includes voiced sounds and unvoiced sounds. Voiced sounds are those caused by vibration of the vocal cords in the air stream generated by the lungs and comprise the vowels of the spoken word. Unvoiced sounds are those that are generated by the vocal tract in the absence of vibration of the vocal cords. The discussion given above with respect to voiced sounds and the formants of FIG. 2 is also applicable to unvoiced sounds, which also have formants caused by resonant cavities of the vocal tract. Unvoiced sounds include consonants, plosives and fricatives. These sounds are generated by action of the tongue, teeth and mouth, which control the release of air from the lungs, but without vibration of the vocal cords. These include sounds of various consonants. Unvoiced sounds include sounds of spoken words involving the letters M, N, L, Z, G (as in frigid), DG (as in judge), etc. These plosives, fricatives, and consonants, although not involving vocal cord vibration, nevertheless have characteristic frequencies, generally higher than the fundamental frequency of vocal cord vibration, and often in the range of 2,000 to 3,000 hertz. Regardless of whether sound produced in the vocal tract is generated by vibration of the vocal cords (voiced sounds), or is generated without vibration of the vocal cords (consonants, plosives, and fricatives), the vocal tract resonances typically operate to produce formants which are resonant peaks in different ones of the harmonics of the generated fundamental frequency.

It has been found that the formants in the human speech make a significant contribution to intelligibility of speech to the listener. That is, the human listener will recognize specific vowels or consonants, plosives, or fricatives by the particular pattern of its formants. This is the pattern of relative frequencies of the several formants. The formant pattern may be based upon fundamental frequencies of higher or lower pitch, such as the higher pitch of the voice of a woman or a child, or the lower pitch of the voice of a man. The pattern of formants, being the relative frequencies of resonant peaks, identifies to the listener the nature of the spoken sound.

Figure 3:
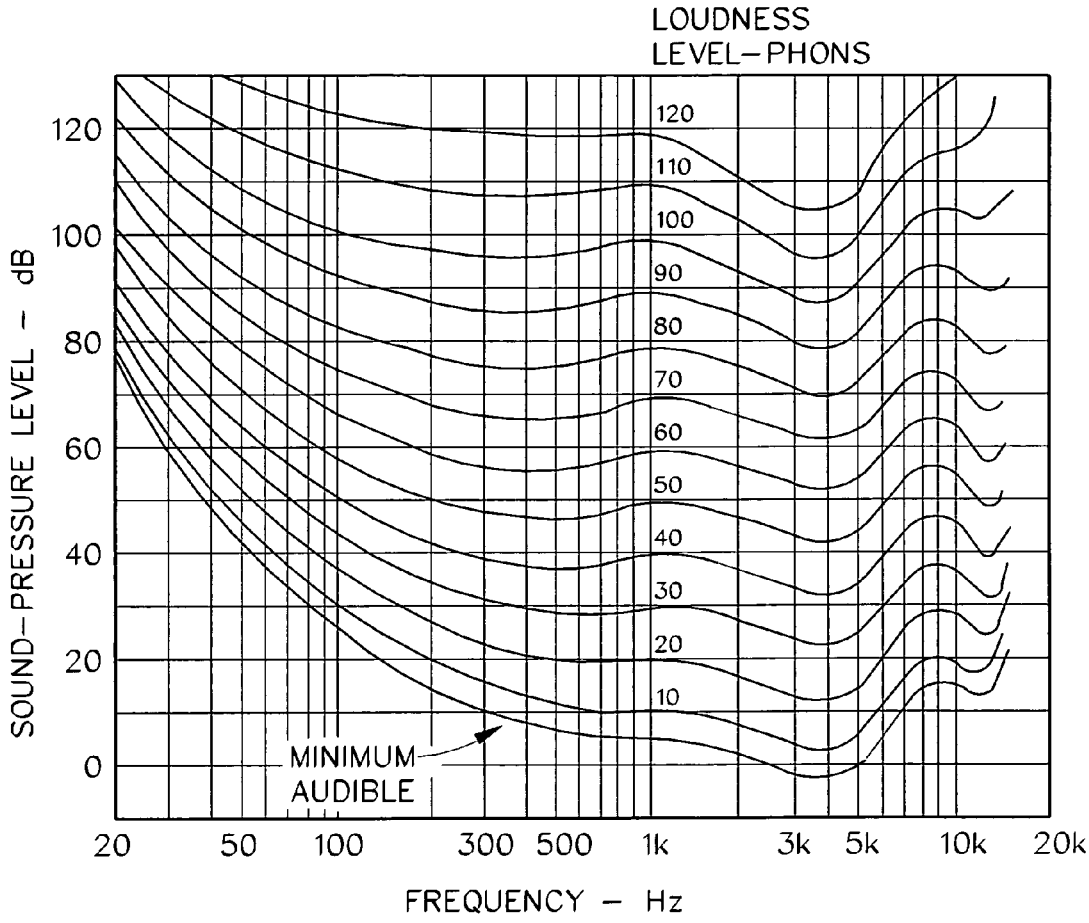
FIG. 3 is a frequency-domain plot of the Fletcher-Munson equal loudness contours for tones in a frontal sound field for humans of average hearing acuity.

There are two components to intelligibility of speech. The first component is speech generation, as discussed above. The second component is speech hearing and perception, or, in other words, the way in which the human hearing system receives and processes speech sounds. The human hearing system is known to be nonlinear. Moreover, the frequency response of the human hearing is dependent on the loudness, or volume, of the sounds being heard. FIG. 3 shows equal loudness contours, often referred to as the Fletcher-Munson curves, for tones in a frontal sound field for humans of average hearing acuity. The loudness level in phons corresponds to the sound pressure levels at 1000 Hz, where, by definition, a 1-kHz tone of a 20 dB sound pressure level has a loudness level of 20 phons.

The contours shown in FIG. 3 can be viewed as inverted frequency response curves of the ear for different sound pressure levels. To give the same sensation of the 20 phon loudness at 100 Hz as 1 kHz, the sound pressure level must be increased about 17 dB. To give the 20 phon loudness at 20 Hz requires a sound pressure level about 62 dB higher than at 1 kHz. This means that the sensitivity of the ear is much less at lower frequencies than at 1 kHz. From the contours in FIG. 3, it is evident that the frequency response of the human ear is, in general, similar to a bandpass-type response which is flatter at higher sound pressure levels.

Different frequencies contained in the spoken voice contribute different amounts to intelligibility of the spoken word. Mid-band frequencies, in the order of about 1.5 to 3.5 kHz, contribute relatively larger percentages to intelligibility. For example, broken down by octaves in the frequency range of about 250 hertz to 5 Kilohertz and above, the octave centered at 250 hertz contributes approximately 7.2% to intelligibility of the spoken voice heard by a human listener, the octave centered at 500 hertz contributes approximately 14.4%, and that centered at 1 kilohertz contributes approximately 22.2%. The octave centered at 2 kilohertz contributes approximately 32.8%, and the octave centered at 4 kilohertz contributes approximately 23.4%.

Table 1 below indicates percentage contribution to intelligibility of different frequency components of a human voice signal that is broken down into one-third octave frequency bands or full octave frequency bands.

TABLE 1

| Band Center Frequency Hz | % Contribution One-Third Octave | % Contribution Octave |
|---|---|---|
| 200 and below | 1.2 | |
| 250 | 3.0 | 7.2 |
| 315 | 3.0 | |
| 400 | 4.2 | |
| 500 | 4.2 | 14.4 |
| 680 | 6.0 | |

TABLE 1-continued

| Band Center Frequency Hz | % Contribution One-Third Octave | % Contribution Octave |
|---|---|---|
| 800 | 6.0 | |
| 1 kHz | 7.2 | 22.2 |
| 1.25 kHz | 9.0 | |
| 1.6 kHz | 11.2 | |
| 2 kHz | 11.4 | 32.8 |
| 2.5 kHz | 10.2 | |
| 3.15 kHz | 10.2 | |
| 4 kHz | 7.2 | 23.4 |
| 5 kHz and above | 6.0 | |

One embodiment of the present invention uses the manner in which speech is generated, and the manner in which speech is heard, to provide speech intelligibility enhancement. The various voiced and unvoiced sounds are filtered and selectively amplified to enhance intelligibility, even in the presence of noise. According to embodiments disclosed herein, voice intelligibility is enhanced by selectively filtering and expanding the components of a speech signal according to the way in which the human hearing system processes speech sounds.

Figure 4:
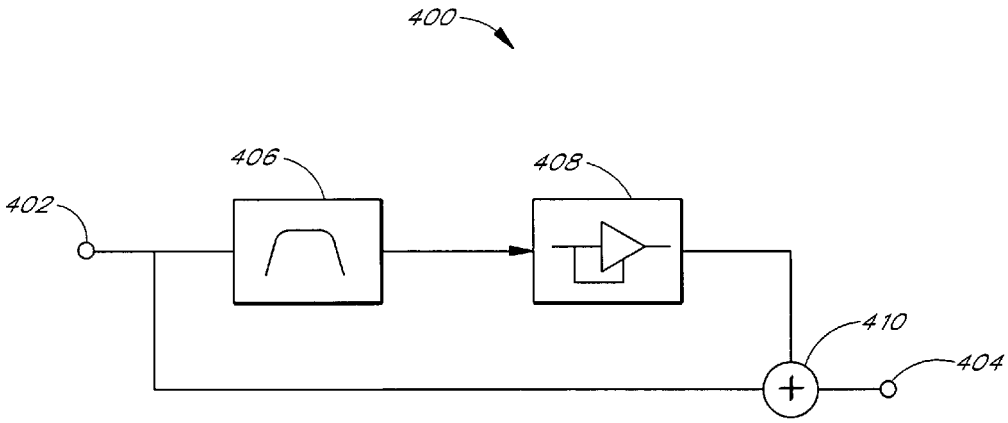
FIG. 4 is a signal processing block diagram of a speech enhancer having an aural filter and a speech expander.

FIG. 4 is a signal processing block diagram 400 of one embodiment of the speech enhancer 106 shown in FIG. 1. The speech enhancer 400 uses an aural filter 406 to provide spectral shaping of the speech signal and a speech expander 408 to generate a time-dependent enhancement factor. FIG. 4 may also be used as a flowchart to describe a program running on a DSP or other processor which implements the signal processing operations of an embodiment of the present invention.

FIG. 4 shows an input 402 and an output 404. The input 402 is provided to a first input of the aural filter 406, and to a first input of a combiner 410. An output of the aural filter 406 is provided to an input of the speech expander 408. An output of the speech expander 408 is provided to second input of the combiner 410. An output of the combiner 410 is provided to the output 404.

FIG. 4 is illustrative to show one signal processing embodiment of the present invention. As such, FIG. 4 is, in some respects, an illustration of a mathematical formula that describes the manipulations performed on the voice signal. One skilled in the art will recognize that, as with most mathematical formulas, the sequence of signal processing operations shown in FIG. 4 can be combined, separated, factored, and otherwise manipulated without changing the transfer function of the block diagram 400. Thus, for example, the feedforward path from the input 402 to the second input of the combiner 410 need not be shown explicitly. The feedforward path can be merged into the aural filter 406 and the speech expander 408. The feedforward path has been made explicit in FIG. 4 for the purpose of clarity of description, and not as a limitation.

In an alternative embodiment, the input 402 is also provided to a gain control input of the speech expander 408 such that the gain of the speech expander is controlled, by at least a portion of the input voice signal.

The speech enhancer provides a transfer function that approximates the inverse (or compliment) of the familiar Fletcher-Munson (F-M) curves shown in FIG. 3. The F-M curves quantify the way in which the human hearing system, particularly the ear, process sounds. As demonstrated by the F-M curves, the frequency response of the human hearing system is non-linear. The human hearing system favors middle frequency sounds over low frequency and high frequency sounds. When the sounds are relatively quiet (e.g., low volume levels) the hearing system strongly favors middle frequency sounds. As the sound increases in volume, the frequency response of the hearing system becomes flatter and the middle frequency sounds are not favored as much.

The input signal to the speech enhancer is a speech signal. When the speech signal is operating at a low volume level, the speech enhancer provides a transfer function that is relatively flatter than the transfer function at high volume levels. Conversely, when the speech signal is operating at high volume levels, the speech enhancer provides a transfer function that produces relatively more gain in the middle frequency ranges than in the low and high frequency ranges. Thus, for example, when an announcer speaking into the microphone is talking very quietly, more of the low and high frequency components of the announcer's voice are provided to the listener. This provides the listener with more information in order to help the listener understand the words.

For a fixed volume setting (such as the volume setting in a public address system) the speech enhancer compensates for the volume of an announcer's voice. For example, when the announcer speaks loudly into the microphone, relatively fewer of the low and high frequency components are provided to the listener. This provides the listener with relatively less information (frequency content) but less information is sufficient because the announcer is talking loudly. The additional information in the low and high frequencies would only serve to increase the overall volume level without adding significantly to the intelligibility of the words. Moreover, when the speaker talks loudly, and the sounds get louder, the hearing system of the listener is more able to perceive the low and high frequency sounds. Thus, even though at high volume levels the speech enhancer is attenuating the low and high frequency sounds with respect to the middle frequency sounds, the listener will not necessarily perceive the full extent of the relative attenuation because the listener's hearing system is providing relatively less attenuation of the low and high frequency sounds.

Stated differently, the speech enhancer is a dynamic filter that provides a transfer function that is a function of one or more properties of the input signal. In one embodiment, the transfer function of the dynamic filter is a function of the volume level of the voice signal (like the human ear wherein the transfer function is a function of the sound pressure level). In one embodiment, the transfer function of the speech enhancer is, in some respects, approximately complementary to the transfer function of the human hearing system. By providing a complementary transfer function, the speech enhancer improves intelligibility, and listener comfort, by reducing the relative volume level of: sounds that are irritating; sounds that do not contribute to (or even reduce) speech intelligibility; sounds that the human hearing system is more able to perceive; and sounds that might cause annoying feedback.

Figure 5:
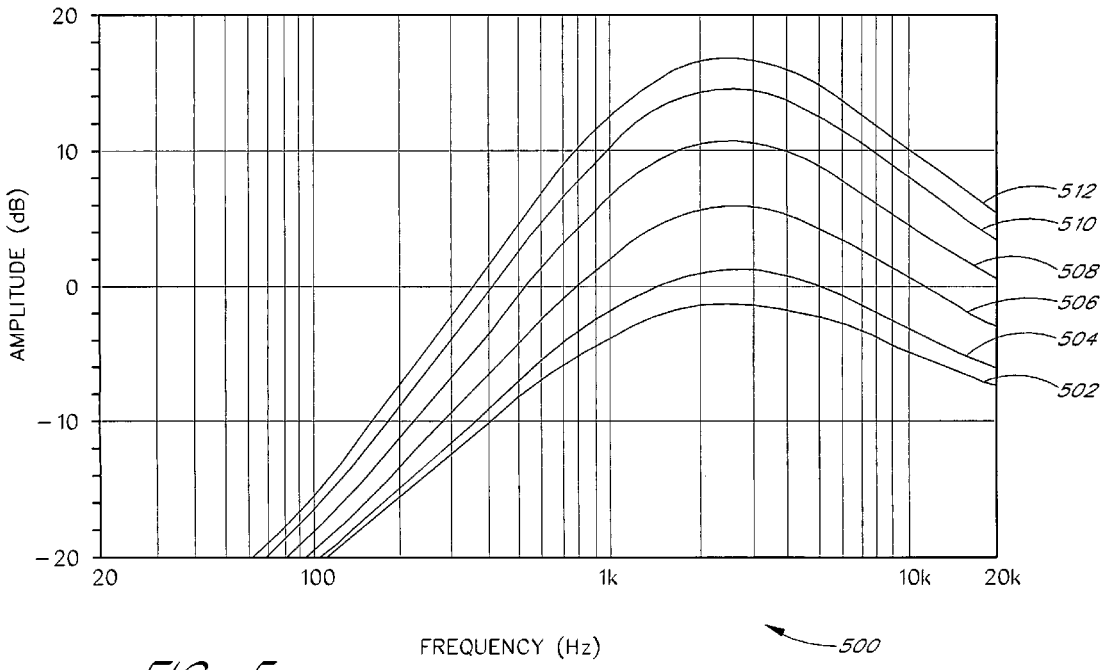
FIG. 5 is a frequency-domain plot of one embodiment of an aural filter combined with a speech expander.

FIG. 5 is a frequency-domain plot that shows a family of six curves that illustrate the general shape of the combined transfer function of the aural filters 406 and speech expander 408. The family of six curves shows a generally bandpass characteristic with a transmission peak in the 2 kHz to 3 kHz range. A curve 502 shows the transfer function of the aural filter 406 alone (i.e., when the speech expander 408 is configured to provide a transfer function of unity). In one embodiment, the speech expander is an amplifier whose gain is a function of the input signal. Thus, as the input signal increases in amplitude, the gain of the speech expander also increases in amplitude. The increase in gain is given by an expansion factor e. In one embodiment, the gain g of the speech expander may be express by the relationship g=k (1+ei), where k is a constant and i is related to the amplitude of the input signal. As discussed below, i may related to the envelope of the input signal, the time average power of the input signal, the Root-Mean-Square (RMS) average of the input signal, etc. When the expansion factor e is zero, then the gain of the speech expander is unity (for k=1), corresponding to the curve 502.

FIG. 5 also shows curves 504, 506, 508, 510 and 512 corresponding approximately to e=0.2, 0.4, 0.6, 0.8, and 1.0 respectively. The amplitude dependence of the gain can be seen by comparing the curve 502 with the curve 512. The curve 502 corresponds to the input of the speech expander (and thus also the output of the speech expander for e=1). At 200 Hz, the amplitude of the curve 502 is approximately −16 dB and the amplitude of the curve 512 at the output of the speech expander is approximately −7 dB, corresponding to a gain of 9 dB. By contrast, at 2000 Hz, the amplitude of the curve 502 is approximately −1 dB and the amplitude of the curve 512 is approximately 16 dB, corresponding to a gain of 17 dB. The curves shown in FIG. 5 are approximately the inverse of the F-M curves shown in FIG. 3 in the range of about 100 Hz to about 20 kHz.

In one embodiment, the speech expander 408 uses an Automatic Gain Control (AGC) comprising a linear amplifier with an internal servo feedback loop. The servo automatically adjusts the average amplitude of the output signal to match the average amplitude of a signal at the control input. The average amplitude of the control input is typically obtained by detecting the envelope of the control signal. The control signal may also be obtained by other methods, including, for example, lowpass filtering, bandpass filtering, peak detection, RMS averaging, mean value averaging, etc.

Figure 6:
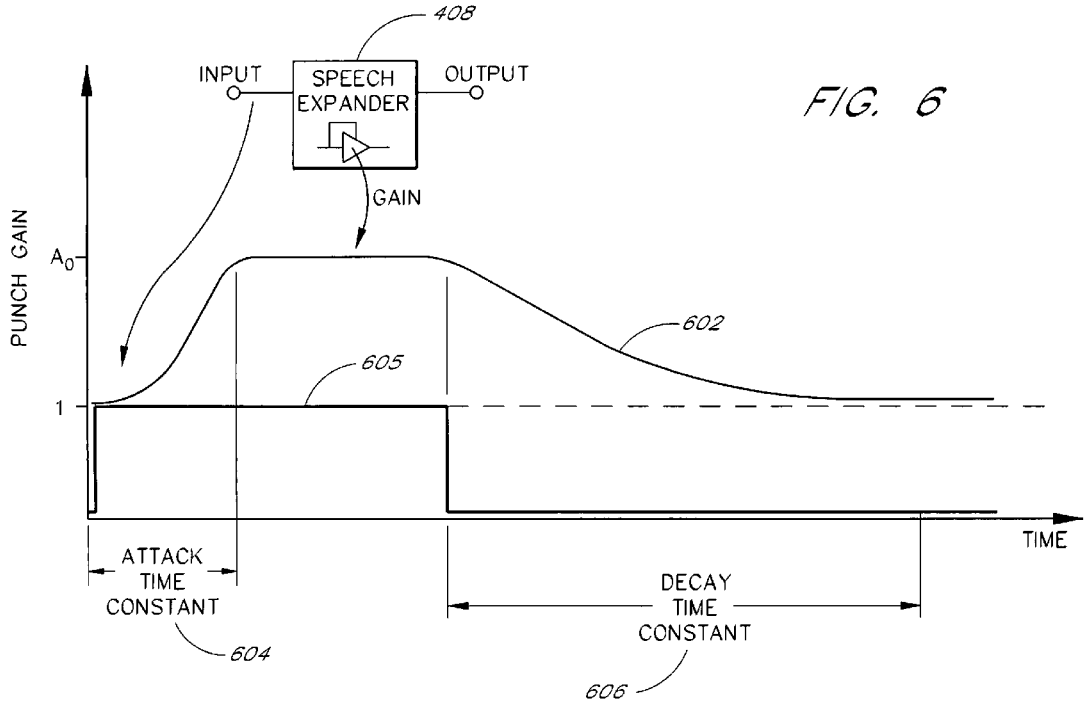
FIG. 6 is a time-domain plot showing the time-amplitude response of one embodiment of a voice expander circuit.

In the speech expander, portions of the input signal are provided to the control input. In response to an increase in the amplitude of the envelope of the signal provided to the input of the speech expander 408, the servo loop increases the forward gain of the speech expander 408. Conversely, in response to a decrease in the amplitude of the envelope of the signal provided to the input of the speech expander 408, the servo loop decreases the forward gain of the speech expander 408. In one embodiment, the gain of the speech expander 408 increases more rapidly that the gain decreases. FIG. 6 is a time domain plot that illustrates the gain of the speech expander 408 in response to an input tone burst having an envelope that is a unit step. One skilled in the art will recognize that FIG. 6 is a plot of gain as a function of time, rather than an output signal as a function of time. Most amplifiers have a gain that is fixed, however, the automatic gain control (AGC) in the speech expander 408 varies the gain of the speech expander 408 in response to some characteristic (such as the envelope) of the input signal.

The envelope unit step input is plotted as a curve 605 and the gain is plotted as a curve 602. In response to the leading edge of the envelope pulse 605, the gain rises during a period 604 corresponding to an attack time constant period 604. At the end of the time period 604, the gain 605 reaches a steady-state gain of $A_0$. In response to the trailing edge of the envelope pulse 605 the gain falls back to zero during a period 606 corresponding to a decay time constant period 606. The attack time constant period 604 and the decay time constant period 606 are desirably selected to provide enhancement of the speech signal while reducing listener discomfort and feedback.

Figure 7:
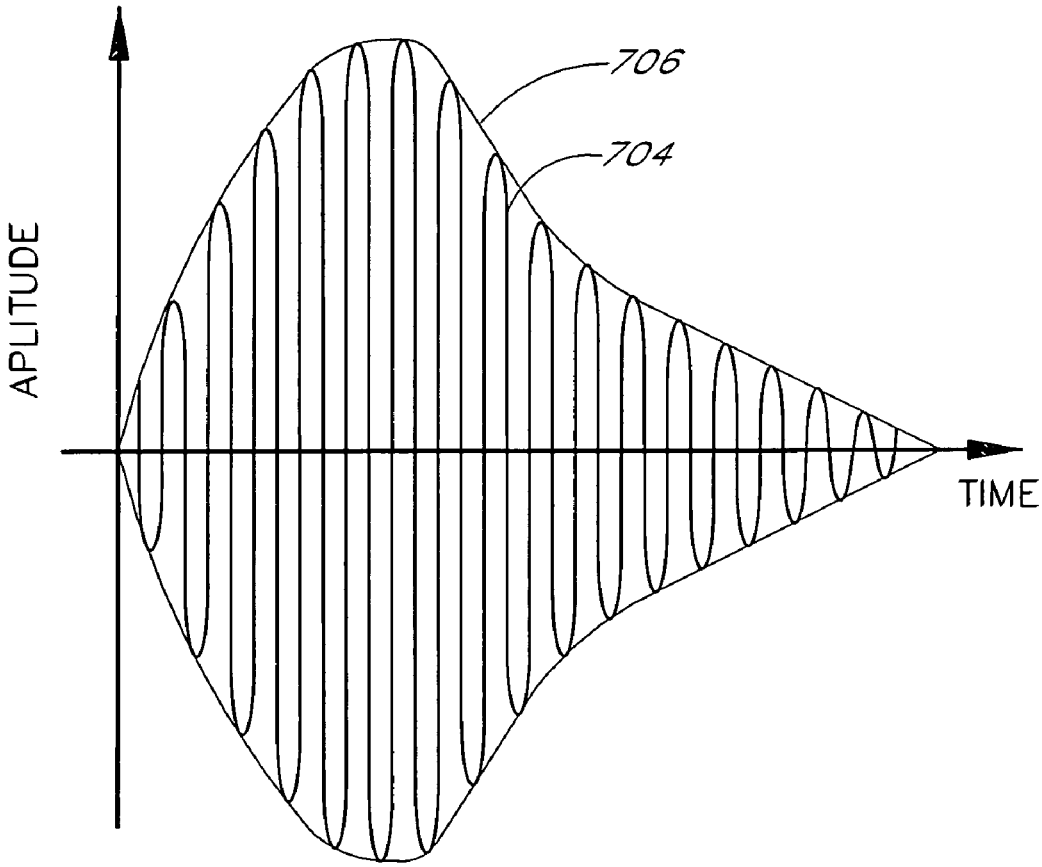
FIG. 7 is a frequency-domain plot of a typical speech vocalization showing a modulated carrier and a modulation envelope.

An understanding of the action of the speech expander can be shown in connection with a speech waveform shown in a plot 700 in FIG. 7A. The plot 700 shows a higher-frequency portion 704 that is amplitude modulated by a lower-frequency portion having a modulation envelope 706. The higher frequency portion 704 corresponds to the formants and other tones produced by the vocal cords. The modulation envelope 706 corresponds to the modulation of the formants and other sounds produced by moving the articulatory organs. Since the vocal chords typically vibrate much faster than the movement of the other articulatory organs, the sound produced by the vocal chords is modulated in amplitude, and frequency, by the other body parts. Short fast speech sounds, such as the consonants in western speech will typically have a modulation envelope that is relatively short with a fast risetime and a high (loud) peak. A vowel sound, on the other hand, will typically have a modulation envelope that is relatively long with a slow risetime and a low peak.

Figure 8A:
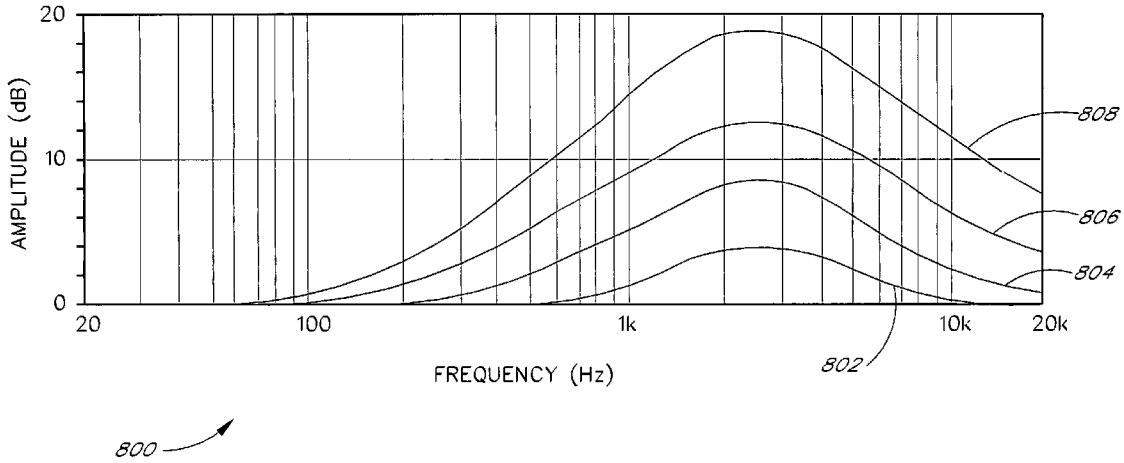
FIG. 8A is a frequency-domain plot showing amplitude response curves for the speech enhancer shown in FIG. 4.

FIG. 8A shows a frequency-domain plot of the amplitude response of the speech enhancer 400. The frequency selection provided by the aural filter 406 biases the action of the speech expander 408 towards a speech (middle) frequency region primarily between about 1 kHz and 5 kHz. In the lower frequency region, the speech enhancer 400 provides a transfer function that approaches unity. In the higher frequency region, the speech enhancer 400 provides relatively less gain than in the speech frequency region.

In the speech region, the speech enhancer 400 provides a varying transfer function, owing to the variable gain of the speech expander 408. FIG. 8A shows a family of gain curves in the speech frequency region, corresponding to input signals with different envelope amplitudes. A curve 802 shows the gain of the speech enhancer 400 for speech signals with a relatively low amplitude. The curve 802 is approximately uniform at 0 dB, showing a slight rise to approximately 4 dB in the middle frequency region. A curve 808 shows the gain of the speech enhancer 400 for speech signals with a relatively large amplitude. The curve 808 rises from approximately 0 dB at low frequencies to almost 20 dB at the middle frequencies and falls below 10 dB at high frequencies. A comparison of the curve 802 with the curve 808 shows that for input signals with a relatively higher envelope amplitude, the gain of speech enhancer 400 in the speech frequency region is larger than the gain for signal with a relatively lower envelope amplitude.

Figure 8B:
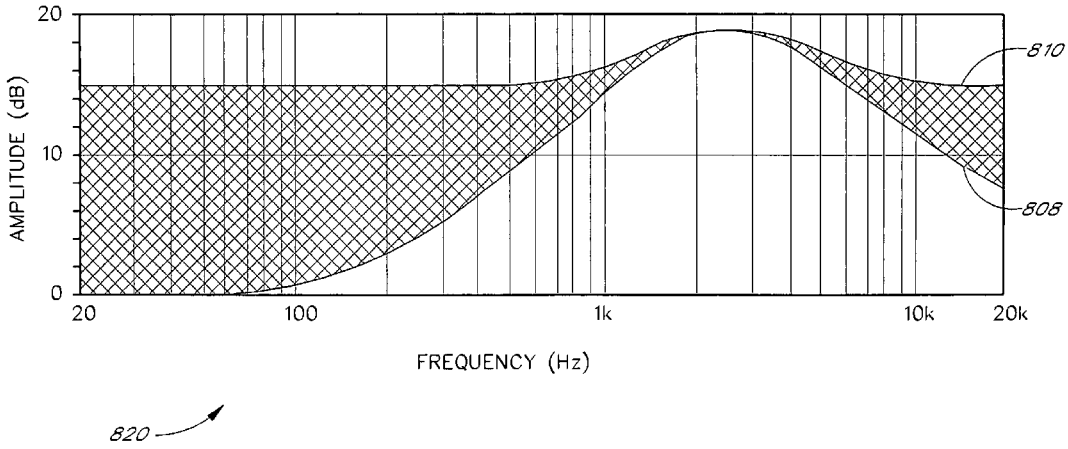
FIG. 8B is a frequency-domain plot showing the improvement provided by the speech enhancer of FIG. 4 as compared to a system that merely increases the volume of speech sounds.

The speech enhancer 400 advantageously shapes the spectrum of the speech signal according to the amplitude of the signal. FIG. 8B show some aspects of the difference between the speech enhancer 400 and a simple volume control. FIG. 8B shows the curve 808, corresponding to relatively high volume signals. FIG. 8B also shows a curve 810, which is the curve 802 (from FIG. 8A) simply increased by a uniform gain of approximately 15 dB. Thus, the curve 810 corresponds to the action of a simple volume control on the curve 802. A hatched region between the curves 810 and 808 represents extra sound energy that would be heard by the listener 114. In other words, the hatched region represents sound that is suppressed by the speech enhancer circuit 400 at relatively high volume levels. This same sound would not be suppressed by a conventional speech system. The extra sound represented by the hatched region is less important for intelligibility, but rather, merely increases the overall sound level, and possible discomfort, perceived by the listener 114. By suppressing sounds in the hatched region, the speech enhancer advantageously improves intelligibility while reducing the overall sound output level, and thereby, increasing listener comfort.

Figure 9A:
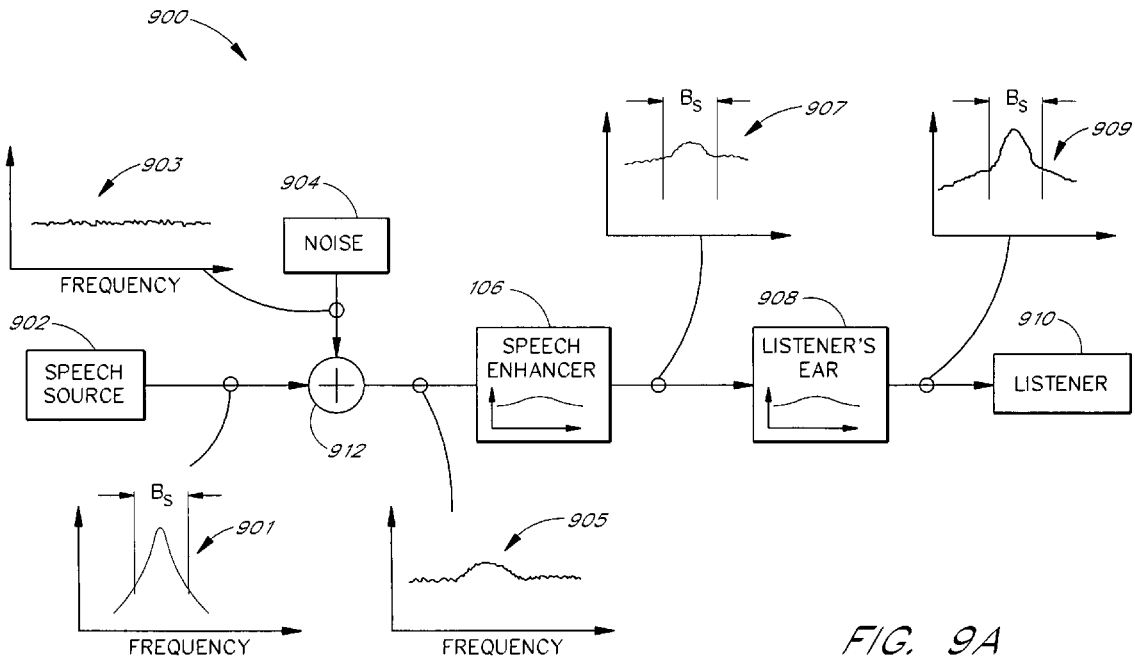
FIG. 9A is a block diagram, with frequency domain plots, showing the operation of the system of FIG. 4 for relatively low volume sounds when the noise source is upstream of the speech enhancer.

The speech enhancer 400 improves intelligibility of voice sounds in the presence of noise, regardless of whether the source of the noise is upstream (before) the speech enhancer or downstream (after) the speech enhancer. FIG. 9A shows the operation of the speech enhancer 106 in a system operating at relatively low volume levels where the source of the noise is upstream of the speech enhancer 106. In FIG. 9A, an output of a speech source 902 is provided to a first input of an adder 912. An output of a noise source 904 is provided to a second input of the adder 912. An output of the adder 912 is provided to the input of the speech enhancer 106. An output of the speech enhancer 106 is provided to a process block 908. The process block 908 represents the response of the human ear (i.e., the ear of the listener 114). An output of the process block 908 is provided to a speech perception block 910. The speech perception block 910 represents the speech perception of the listener 114.

A frequency-domain plot 901 shows an example of a frequency response plot of the output from the speech source 902. A frequency-domain plot 903 shows another exemplary frequency response plot of the output from the noise source 904. A frequency-domain plot 905 shows an exemplary frequency response plot of the output from the speech adder 912. A frequency-domain plot 907 shows an exemplary frequency response plot of the output from the speech enhancer 106. A frequency-domain plot 909 shows an exemplary frequency response plot of the output from the process block 908.

As shown in the plot 901, most of the frequency components of the speech signal from the source 902 lie in a middle frequency range having a bandwidth B. As shown in the plot 905, when the amplitude of the speech signal is relatively low, then the noise will contaminate the speech. For speech signals of relatively low amplitude, the gain of the speech enhancer 106 is relatively uniform, and thus the plot 907 is similar to the plot 905. However, at low volume levels, the human ear is relatively more sensitive to sounds within the bandwidth B and relatively less sensitive to sounds outside the bandwidth B. Thus, the plot 909 shows that more of the information within the bandwidth B reaches the speech perception block 910. The relatively uniform response curve of the speech enhancer 106 at low volume levels means that a substantial portion of the available speech is signal is provided to the listener 114, thus providing the listener 114 with more information.

Figure 9B:
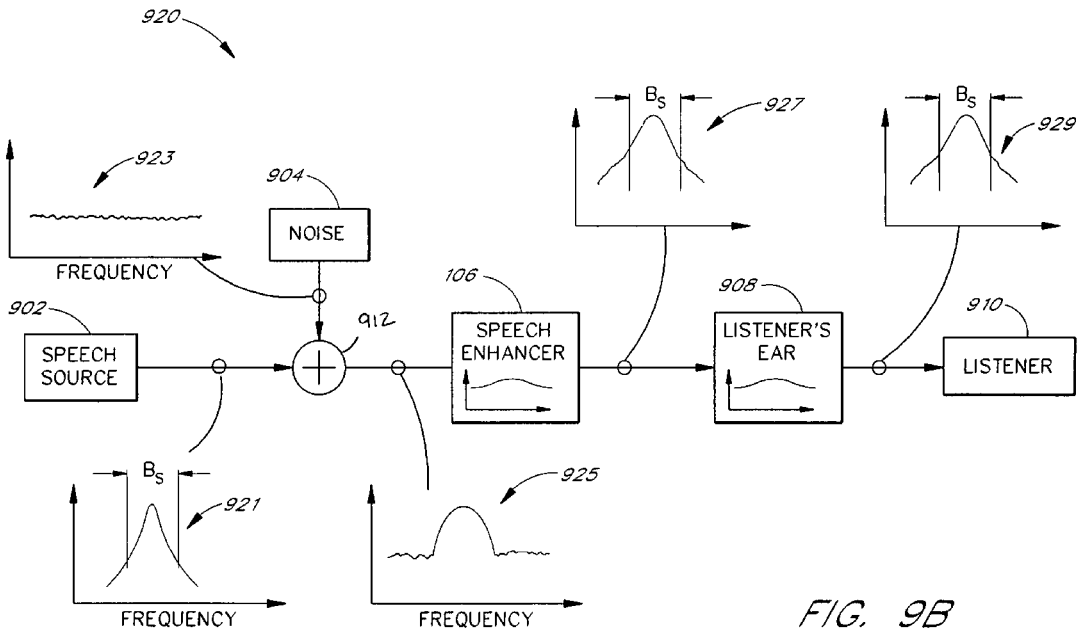
FIG. 9B is a block diagram, with frequency domain plots, showing the operation of the system of FIG. 4 for relatively high volume sounds when the noise source is upstream of the speech enhancer.

FIG. 9B is similar to FIG. 9A, however, FIG. 9B shows the operation of the speech enhancer 106 in a system operating at relatively high volume levels. A frequency-domain plot 921 shows an exemplary frequency response plot of the output from the speech source 902. A frequency-domain plot 923 shows an exemplary frequency response plot of the output from the noise source 904. A frequency-domain plot 925 shows an exemplary frequency response plot of the output from the adder 912. A frequency-domain plot 927 shows an exemplary frequency response plot of the output from the speech enhancer 106. A frequency-domain plot 929 shows an exemplary frequency response plot of the output from the process block 908.

For speech signals of relatively high amplitude, the gain of the speech enhancer 106 is higher in the middle frequency regions than in the low and high frequency regions, and thus the plot 927 has a high frequency rolloff and a low frequency rolloff not seen in the plot 905. The rolloff at high and low frequencies reduces the low and high frequency components of the noise without significantly reducing the portions of the signal containing speech information. At high volume levels, the response of the human ear is relatively uniform, and thus, the plot 929 is similar to the plot 927.

Figure 9C:
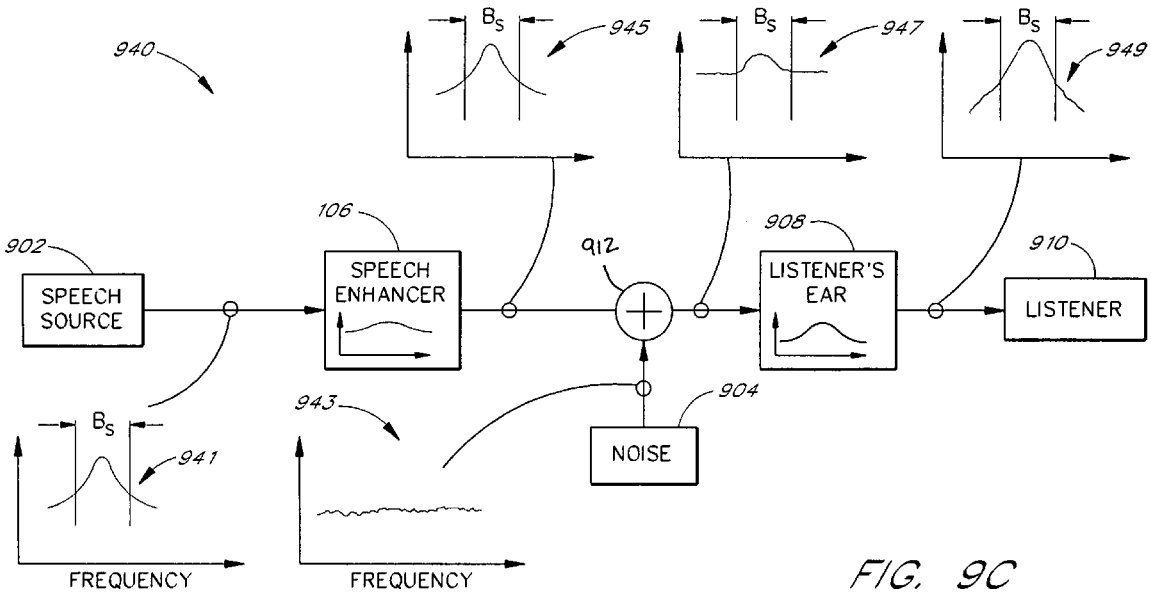
FIG. 9C is a block diagram, with frequency domain plots, showing the operation of the system of FIG. 4 for relatively low volume sounds when the noise source is downstream of the speech enhancer.

FIG. 9C shows the operation of the speech enhancer 106 in a system operating at relatively low volume levels where the source of the noise is downstream of the speech enhancer 106. In FIG. 9C, the output of the speech source 902 is provided to the input of the speech enhancer 106. The output of the speech enhancer 106 is provided to the first input of the adder 912. The output of the noise source 904 is provided to the second input of the adder 912. The output of the adder 912 is provided to the input the process block 908. The output of the process block 908 is provided to the speech perception block 910.

A frequency-domain plot 941 shows an exemplary frequency response plot of the output from the speech source 902. A frequency-domain plot 943 shows an exemplary frequency response plot of the output from the noise source 904. A frequency-domain plot 945 shows an exemplary frequency response plot of the output from the speech enhancer 106. A frequency-domain plot 947 shows an exemplary frequency response plot of the output from the adder 912. A frequency-domain plot 909 shows an exemplary frequency response plot of the output from the process block 908.

FIG. 9C shows that for speech signals of relatively low amplitude, the gain of the speech enhancer 106 is relatively uniform, and thus the plot 945 is similar to the plot 941. The speech enhancer 106 does not significantly reduce the amplitude of the low or high frequency components of the speech signal. The relatively uniform response curve of the speech enhancer 106 at low volume levels means that a substantial portion of the available speech is signal is provided at the output of the speech enhancer 106 so that the noise signal is less likely to degrade the speech signal (especially the low and high frequency components of the speech signal).

Figure 9D:
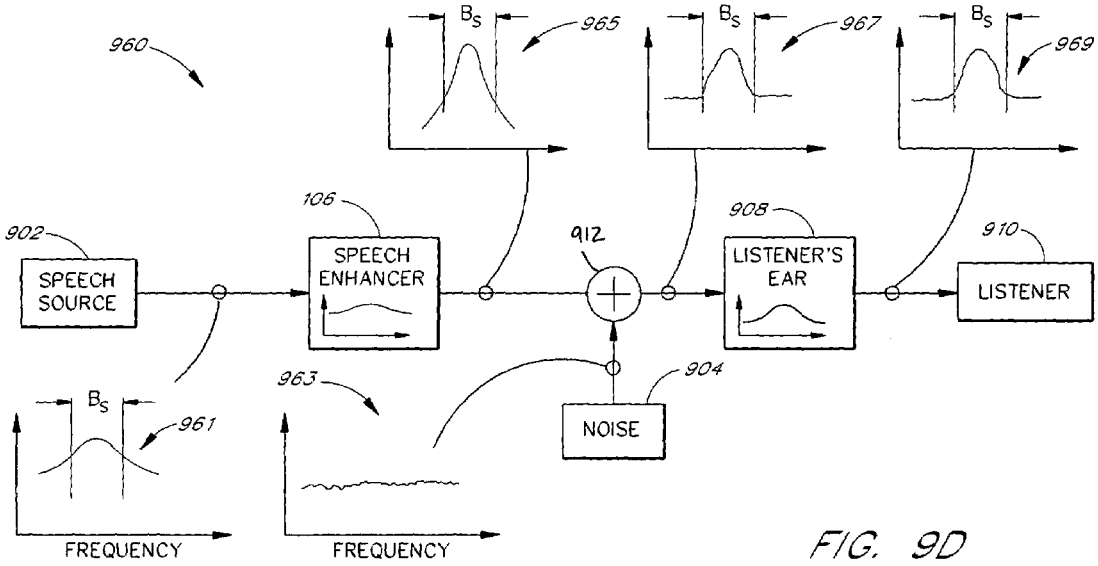
FIG. 9D is a block diagram, with frequency domain plots, showing the operation of the system of FIG. 4 for relatively high volume sounds when the noise source is downstream of the speech enhancer.

FIG. 9D is similar to FIG. 9C, however, FIG. 9D shows the operation of the speech enhancer 106 in a system operating at relatively high volume levels. A frequency-domain plot 961 shows an exemplary frequency response plot of the output from the speech source 902. A frequency-domain plot 963 shows an exemplary frequency response plot of the output from the noise source 904. A frequency-domain plot 965 shows an exemplary frequency response plot of the output from the speech enhancer 106. A frequency-domain plot 967 shows an exemplary frequency response plot of the output from the adder 912. A frequency-domain plot 969 shows an exemplary frequency response plot of the output from the process block 908.

For speech signals of relatively high amplitude, the gain of the speech enhancer 106 is significantly higher in the bandwidth B than in the low and high frequency regions outside B. Thus, the plot 965 has a low frequency rolloff and a high frequency rolloff not seen in the plot 961. The rolloff at low and high frequencies reduces the low and high frequency components of the speech signal that are relatively less important for intelligibility, thus minimizing the potential for listener discomfort at high volume levels. At high amplitudes, the noise signal 963 is less likely to degrade the voice signal 965, and thus the plot 967 is similar to the plot 965 inside the bandwidth B. At high volume levels the frequency response of the human ear, as represented by the process block 908, is relatively uniform and thus the signal 969 is similar to the signal 967.

Figure 10:
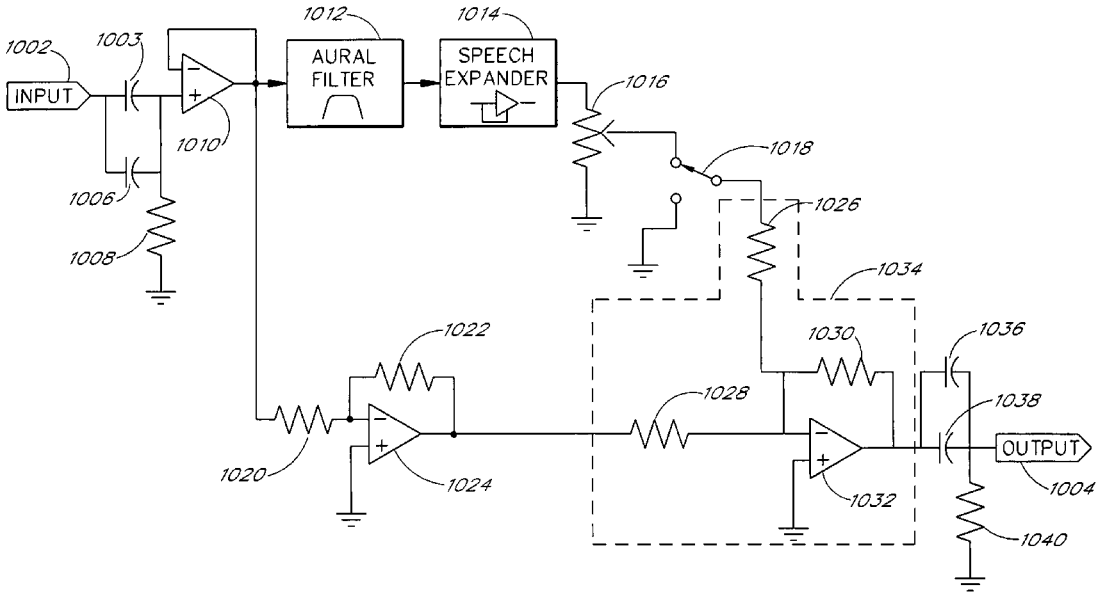
FIG. 10 shows one embodiment of a circuit diagram that implements the speech enhancer shown in FIG. 4.

FIG. 10 is a circuit schematic showing one embodiment of the speech enhancer 400 shown in FIG. 4. In FIG. 10, an input 1002 is provided to a first terminal of a DC-blocking capacitor 1003 and to a first terminal of a DC-blocking capacitor 1006. The input 1002 is provided voice information from a voice source, such as the source 103, including, for example, a microphone, a transducer, a speech generator, a receiver, a computer, etc.

A second terminal of the capacitor 1003 and a second terminal of the capacitor 1006 are provided to a first terminal of a resistor 1008. The first terminal of the resistor 1008 is also provided to a non-inverting input of an operational amplifier (op-amp) 1010. A second terminal of the resistor 108 is provided to ground.

An output of the op-amp 1010 is provided to an inverting input of the op-amp 1010, to an input of an aural filter 1012, and to a first terminal of a resistor 1020. An output of the aural filter 1012 is provided to an input of a speech expander 1014. An output of the speech expander 1014 is provided to a first fixed terminal of a potentiometer 1016. A second fixed terminal of the potentiometer 1016 is provided to ground and a wiper of the potentiometer 1016 is provided to a first throw of a single pole double throw (SPDT) switch 1018. The second throw of the SPDT switch 1018 is provided to ground. The pole of the SPDT switch 1018 is provided to a first terminal of a resistor 1026.

Returning to the resistor 1020, a second terminal of the resistor 1020 is provided to an inverting input of an op-amp 1024 and to a first terminal of a resistor 1022. A non-inverting input of the op-amp 1024 is provided to ground. An output of the op-amp 1024 is provided to a second terminal of the resistor 1022 and to a first terminal of a resistor 1028.

A second terminal of the resistor 1026, and a second terminal of the resistor 1028 are provided to an inverting input of an op-amp 1032. A non-inverting input of the op-amp 1032 is provided to ground. An output of the op-amp 1032 is provided to a first terminal of a feedback resistor 1030. A second terminal of the feedback resistor 1030 is provided to the inverting input of the op-amp 1032. The output of the op-amp 1032 is also provided to a first terminal of a DC-blocking capacitor 1036 and to a first terminal of a DC-blocking capacitor 1038.

A second terminal of the capacitor 1036 and a second terminal of the capacitor 1038 are provided to a first terminal of a resistor 1040. The first terminal of the resistor 1040 is provided to an output 1004 and a second terminal of the resistor 1040 is provided to ground.

The resistors 1026, 1028, and 1030 in combination with the op-amp 1032 are shown as a combiner 1034.

In one embodiment, the DC-blocking capacitors 1003 and 1036 are 4.7 uF capacitors and the capacitors 1006 and 1038 are 0.01 uF capacitors. The resistor 1008 is a 100 k-ohm resistor, the resistor 1040 is a 2.7 k-ohm resistor, and the resistors 1028, 1030, and 1032 are 10 k-ohm resistors. The potentiometer is a 1.0 k-ohm linear potentiometer. The op-amps 1010, 1024, and 1032 are TL074 op-amps supplied by Texas Instruments, Inc. (or any other similar amplifiers).

The output of the speech expander 1014 is an enhanced speech signal that is combined with the speech input signal (provided at the output of the op-amp 1024) by the combiner 1034. The optional switch 1018 is provided to disable the speech enhancement processing by disconnecting the signal path from the speech expander 1014 to the combiner 1034. The potentiometer 1016 is provided to allow an adjustment of the amount of speech enhancement by selecting the amount of enhanced speech signal that is provided to the combiner 1034.

The potentiometer 1016 controls the amount of speech enhancement. An enhanced signal is provided at the output of the speech expander 1014. The enhanced signal is added to the input signal from the input 1002 by the combiner 1034. The potentiometer controls how much of the enhanced signal is combined with the input signal to produce an output signal at the output 1004. The potentiometer 1016 controls the amount of enhanced signal that is combined with the input signal to produce the output signal. The switch 1016 is provided to disable the speech enhancement processing such that the output signal at the output 1004 is linearly similar to the input signal at the input 1002.

Figure 11:
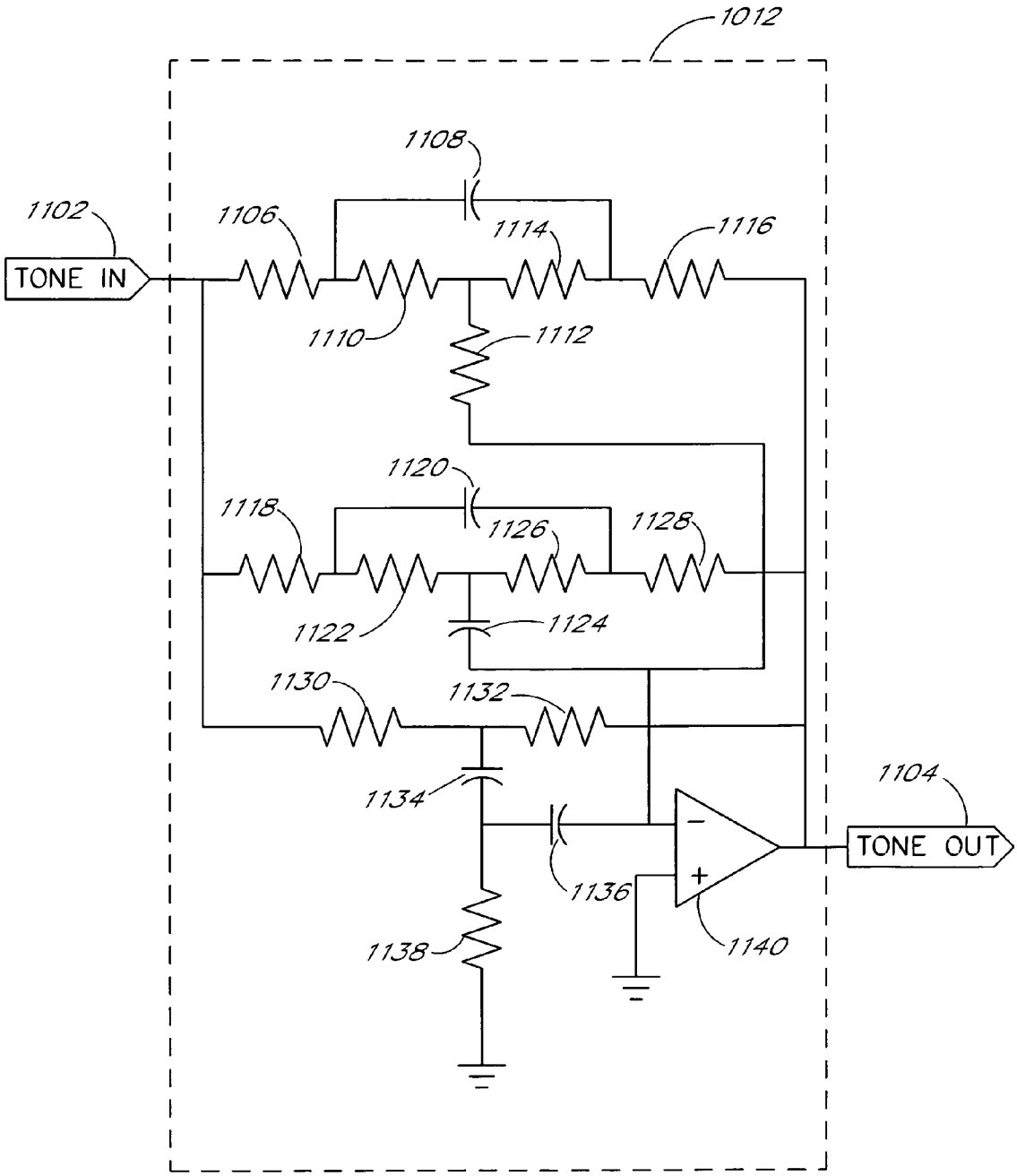
FIG. 11 is a circuit diagram of one implementation of an aural filter.

One embodiment of the aural filter 1012 is shown in FIG. 11, where the aural filter 1012 has an input 1102 and an output 1104. The input 1102 is provided to a first terminal of a resistor 1106, to a first terminal of a resistor 1118, and to a first terminal of a resistor 1130. A second terminal of the resistor 1106 is provided to a first terminal of a resistor 1110 and to a first terminal of a capacitor 1108. A second terminal of the resistor 1110 is provided to a first terminal of a resistor 1112 and to a first terminal of a resistor 1114. A second terminal of the resistor 1114 is provided to a second terminal of the capacitor 1108 and to a first terminal of a resistor 1116. A second terminal of the resistor 1116 is provided to an output of an op-amp 1140.

Returning to the resistor 1118, a second terminal of the resistor 1118 is provided to a first terminal of a resistor 1122 and to a first terminal of a capacitor 1120. A second terminal of the resistor 1122 is provided to a first terminal of a resistor 1126 and to a first terminal of a capacitor 1124. A second terminal of the resistor 1126 is provided to a second terminal of the capacitor 1120 and to a first terminal of a resistor 1128. A second terminal of the resistor 1128 is provided to an output of the op-amp 1140.

A second terminal of the resistor 1112 and a second terminal of the capacitor 1124 are provided to an inverting input of the op-amp 1140.

Returning to the resistor 1130, a second terminal of the resistor 1130 is provided to a first terminal of a capacitor 1134 and to a first terminal of a resistor 1132. A second terminal of the resistor 1132 is provided to the output of the op-amp 1140. A second terminal of the capacitor 1134 is provided to a first terminal of a capacitor 1136 and to a first terminal of a resistor 1138. A second terminal of the resistor 1138 is provided to ground, and a second terminal of the capacitor 1136 is provide to the inverting input of the op-amp 1140.

A non-inverting input of the op-amp 1140 is provided to ground, and the output of the op-amp 1140 is provided to the output 1104.

In a preferred embodiment, the op-amp 1140 is a TL074 op-amp, and the values for the resistors and capacitors in the aural filter 1012 are listed in Table 2 below.

TABLE 2

| Resistor | Resistance (k-ohms) | Capacitor | Capacitance (uF) |
|---|---|---|---|
| 1106 | 11.0 | 1108 | 0.047 |
| 1110 | 84.5 | 1120 | 0.0022 |
| 1112 | 11.0 | 1124 | 0.01 |
| 1114 | 10.7 | 1134 | 0.0047 |
| 1116 | 11.0 | 1136 | 0.1 |
| 1118 | 3.65 | | |
| 1122 | 6.34 | | |
| 1126 | 97.6 | | |
| 1128 | 3.65 | | |
| 1130 | 0.95 | | |
| 1132 | 453.0 | | |
| 1138 | 0.274 | | |

Figure 12:
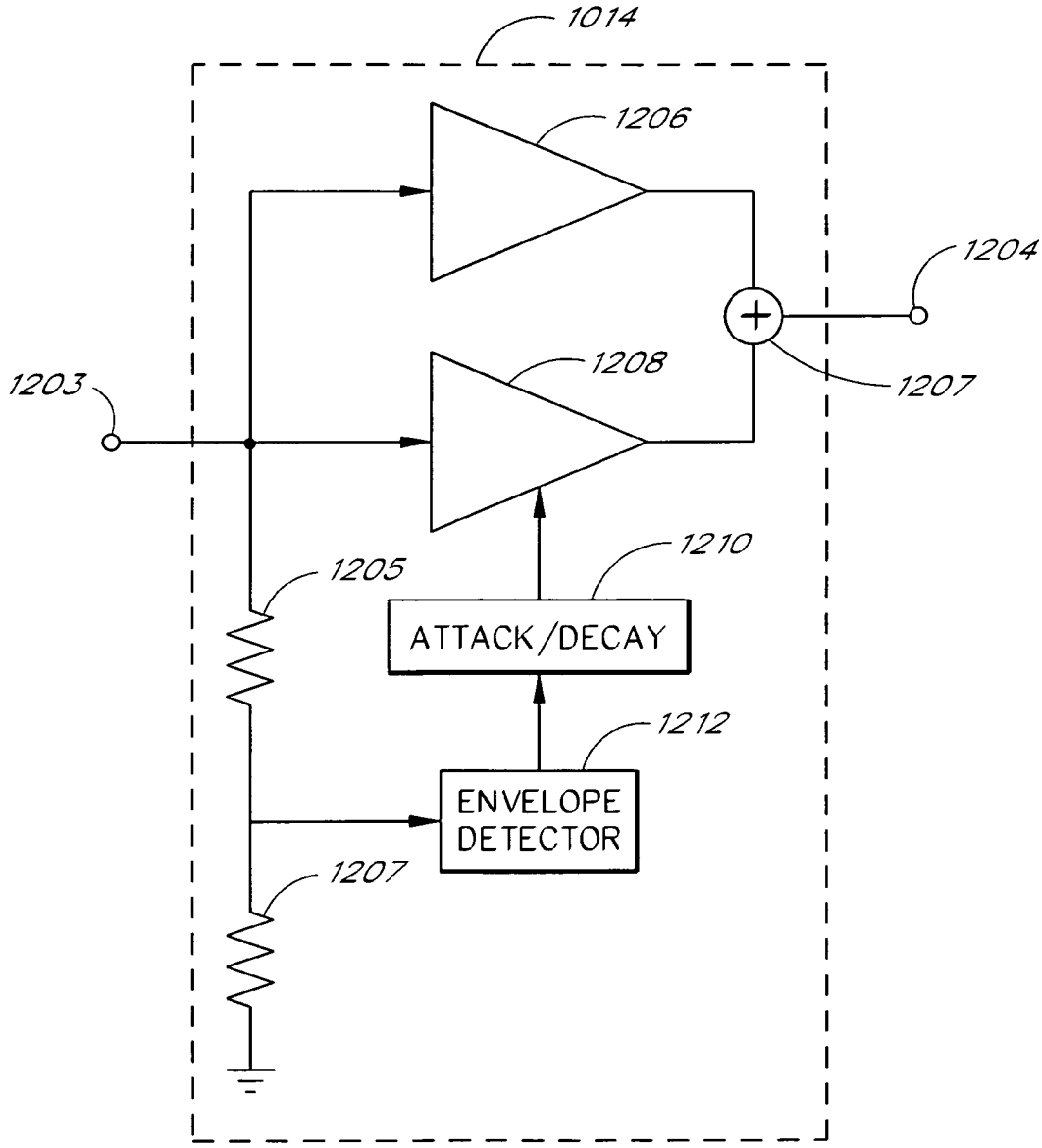
FIG. 12 is a block diagram of one embodiment of a speech expander.
Figure 13:
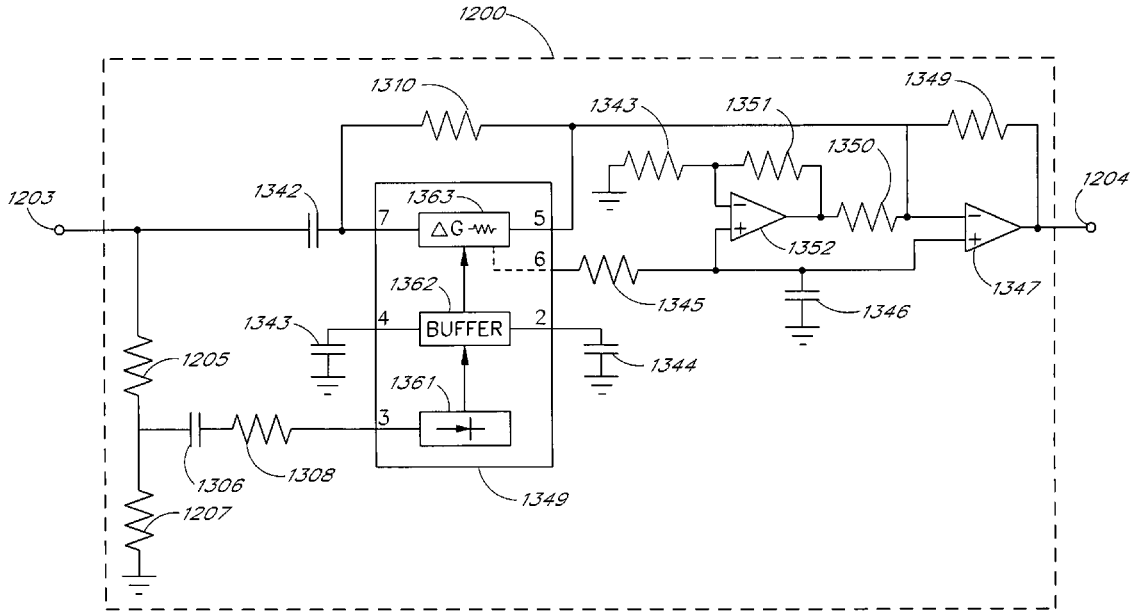
FIG. 13 is a circuit diagram of one implementation of the speech expander shown in FIG. 12.

A block diagram of one embodiment of the speech expander 1014 is shown in FIG. 12 as a block diagram, and a corresponding circuit diagram is shown in FIG. 13. In FIG. 12, an input 1203 is provided to a first input of a fixed gain amplifier 1206, to a first input of a variable gain amplifier 1208, and to a first terminal of a resistor 1205. A second terminal of the resistor 1205 is provided to a first terminal of a grounded resistor 1207 and to an input of an envelope detector 1212. An output of the envelope detector 1212 is provided to an attack/decay buffer 1210. An output of the attack/decay buffer 1210 is provided to a gain control input of the gain-controlled amplifier 1208. An output of the fixed gain amplifier 1206 is provided to a first input of an output adder 1207 and an output of the variable gain amplifier 1208 is provided to a second input of the output adder 1207. An output of the output adder 1207 is provided to a speech expander output 1204.

The fixed gain amplifier 1206 provides a unity gain feedforward path to the output adder 1204. Thus, even if the gain of the gain-controlled amplifier 1208 is zero, the feedforward path will provide the speech expander 1014 with a minimum gain of 1.0. The resistors 1205 and 1207 are connected as a voltage divider to select a portion of the input signal provided at the input 1203. The selected portion is provided to the envelope detector 1212. The output of the envelope detector is a signal that approximates the envelope of the input signal. The envelope signal is provided to the attack/decay buffer. When the envelope signal has a positive slope (rising edge) the attack/decay buffer provides a signal to increase the gain of the gain-controlled amplifier at a rate given by the attack time constant. When the envelope signal has a negative slope (falling edge) the attack/decay buffer provides a signal to decrease the gain of the gain-controlled amplifier at a rate given by the decay time constant.

The speech expander 1014 shown in FIG. 12 is an expander because the gain of the speech expander 1014, and thus the output level, is controlled by the input signal. As the average amplitude of the envelope of the input signal increased, the gain increases. Conversely, as the average amplitude of the envelope of the input signal level decreases, the gain decreases. The voltage divider (resistors 1205 and 1207) is desirably constructed to provide sufficient expansion of the input signal to enhance the intelligibility of speech.

FIG. 13 is a circuit diagram illustrating one embodiment of the speech expander 1014. In FIG. 13, the input 1203 is provided to a first terminal of a capacitor 1342 and to the first terminal of the resistor 1205. The second terminal of the resistor 1205 is provided to a first terminal of a capacitor 1306 and to the first terminal of the grounded resistor 1207. A second terminal of the capacitor 1306 is provided to a first terminal of a resistor 1308 and a second terminal of the resistor 1308 is provided to an envelope detector input (pin 3) of a gain control circuit 1349. In one embodiment, the gain control circuit 1349 is an NE572.

The NE572 is a dual-channel, high-performance gain control circuit in which either channel may be used for dynamic range compression or expansion. Each channel has a full-wave rectifier to detect the average value of input signal, a linearized, temperature-compensated variable gain cell and a dynamic time constant buffer. The buffer permits independent control of dynamic attack and recovery time with minimum external components and improved low-frequency gain control ripple distortion. Pin-outs for the NE572 are listed in Table 3 (where n,m designates channels A,B). The NE572 is used in the present embodiments as an inexpensive, low-noise, low distortion, gain controlled amplifier. One skilled in the art will recognize that other gain-controlled amplifiers can be used as well.

TABLE 3

| Pin | Function |
|---|---|
| 1,15 | Tracking Trim |
| 2,14 | Recovery |
| 3,13 | Rectifier input |
| 4,12 | Attack |
| 5,11 | Vout |
| 6,10 | THD trim |
| 7,9 | Vin |
| 8 | Ground |
| 16 | Vcc |

A first terminal of an attack timing capacitor 1343 is provided to an attack control input (pin 4) of the gain control circuit 1349 and a second terminal of the attack timing capacitor 1343 is provided to ground. A first terminal of a decay timing capacitor 1344 is provided to a decay control input (pin 2) of the gain control circuit 1349 and a second terminal of the decay timing capacitor 1344 is provided to ground.

A second terminal of the capacitor 1342 is provided to a $V_{in}$ terminal (pin 7) of the gain control circuit 1349 and to a first terminal of a resistor 1310. A second terminal of the resistor 1310 is provided to a $V_{out}$, terminal (pin 5) of the gain control circuit 1349 and to an inverting input of an op-amp 1347. A non-inverting input of the op-amp 1347 is provided to a terminal of a grounded capacitor 1346, to a non-inverting input of an op-amp 1352, and to a first terminal of a resistor 1345. A second terminal of the resistor 1345 is provided to a THD terminal (pin 6) of the gain control circuit 1349.

An output of the op-amp 1347 is provided to the output 1204 and to a first terminal of a feedback resistor 1349. A second terminal of the feedback resistor 1349 is provided to the inverting input of the op-amp 1347.

An inverting input of the op-amp 1352 is provided to a terminal of a grounded resistor 1343 and to a first terminal of a feedback resistor 1351. A second terminal of the feedback resistor 1351 is provided to an output of the op-amp 1352 and to a first terminal of a resistor 1350. A second terminal of the resistor 1350 is provided to the inverting input of the op-amp 1347.

In one embodiment, the capacitors 1342, 1306, and 1346 are 2.2 uF capacitors. The attack timing 1343 capacitor is a 0.10 uF capacitor and the decay timing capacitor 1344 is a 1.0 uF capacitor. The resistor 1348 is a 3.1 k-ohm resistor, and the resistors 1345 is a 1.0 k-ohm resistor. The resistors 1353 and 1351 are 10 k-ohm resistors, and the resistors 1310, 1349, and 1350 are 17.4 k-ohm resistors.

The gain control circuit 1349 includes an envelope detector 1361, an attack/decay buffer 1362, and a gain element 1363. As in the block diagram in FIG. 12, an output of the envelope detector 1361 is provided to the attack/decay buffer 1362, and an output of the attack/decay buffer 1362 controls the gain element 1363. The attack and delay time constants are controlled by resistor-capacitor (RC) networks. The attack/decay buffer 1362 provides an internal 10 k-ohm resistor for the attack RC network and an internal 10 k-ohm resistor for the decay RC network. The 0.1 uF attack capacitor 1343 produces an attack time constant of approximately 4.0 ms (milliseconds). The 1.0 uF decay capacitor 1344 produces a decay time constant of approximately 40.0 ms. In other embodiments the attack time constant may range from 1 ms to 40 ms and the decay time constant may range from 10 ms to 100 ms.

The gain element 1363 is similar to an electronically variable resistor and used in connection with the feedback circuit of the op-amp 1347 to vary the gain of the op-amp 1347. The op-amp 1352 provides a DC bias. The unity gain feedforward path is provided by the resistor 1310.

Recordings

As described above, FIG. 1B illustrates use of voice processing methods and apparatus of the present invention applied to a voice communication system. It will be readily appreciated that the same voice processing can be applied to the making of any suitable recording, which is later employed as the sound input to a conventional playback system. In making such a recording, using the voice processing and intelligibility enhancement techniques described herein, the resulting recording inherently includes the intelligibility enhancement provided by the processing circuitry. Therefore, no further intelligibility enhancement processing is needed when such a recording is played through a conventional playback system.

To make such a recording there is used a system substantially the same as that shown in FIG. 1B, so that the sound recorded on the tape or other record medium includes the enhanced speech signal processed by the system 400 shown in FIG. 4.

The described processing will also provide an intelligibility enhanced recording where the input sound comprises a spoken voice that originates in a noisy environment. Such a condition exists in many situations, such as, for example, in the case of a cockpit voice recorder (CVR), which is a recording device carried in the cockpit of commercial aircraft for the purpose of making a record of occurrences and conversations of the personnel in the aircraft cockpit. The cockpit environment is exceedingly noisy, so that, in the past, recordings made by the cockpit voice recorder have been difficult to comprehend because of their degraded intelligibility.

The present invention is applicable to such a cockpit voice recorder to enhance intelligibility of the recorded sound when played back on conventional playback equipment. An intelligibility enhanced cockpit voice recorder of the present invention is substantially the same as the system illustrated in FIG. 1B.

OTHER EMBODIMENTS

Although the foregoing has been a description and illustration of specific embodiments of the invention, various modifications and changes can be made thereto by persons skilled in the art, without departing from the scope and spirit of the invention as defined by the following claims.

What is claimed is:

1. A system for enhancing intelligibility of a voice signal that is degraded by factors that reduce intelligibility of the voice signal, said system comprising:

an input configured to receive a voice signal that includes human spoken words;

an aural filter operatively coupled to said input, said aural filter configured to filter said voice signal to produce a filter output signal wherein low frequencies below speech frequencies and high frequencies above speech frequencies are attenuated with respect to speech frequencies;

a speech expander operatively coupled to said aural filter to produce an expanded signal, said speech expander configured to amplify said filter output signal according to an amplifier gain, wherein said amplifier gain is a function of an envelope amplitude of said filter output signal; and a combiner configured to combine at least a portion of said expanded signal and at least a portion of said voice signal to produce an enhanced signal representing said spoken words;

wherein, when the voice signal is operating a high volume levels, the system emphasizes middle speech frequencies over low and high frequencies; and wherein, when the voice signal is operating at low volume levels, the system provides more low and high frequency components of the voice signal than when the voice signal is operating a high volume levels;

such that the system provides a transfer function which approximates an inverse of the transfer function of human hearing.

2. The system of claim 1, wherein said speech expander comprises an envelope detector and a gain controlled amplifier, wherein at least a portion of said filter output signal is provided to an input of said envelope detector configured to detect an envelope amplitude of said at least a portion of said filter output signal.

3. The system of claim 1, wherein said amplifier gain increases according to an attack time constant and said amplifier gain decreases according to a decay time constant.

4. A communication device for sending voice information to a communication receiver, where the voice information may become contaminated by noise that reduces the intelligibility of the voice information, said communication device comprising:

a sender configured to send a voice signal comprising words spoken by a person over a communication channel; and a voice enhancer operably connected to said sender, said voice enhancer comprising:

an aural filter operatively coupled to a voice signal in said sender, said aural filter configured to filter said voice signal to produce a filter output signal wherein low frequencies below speech frequencies and high frequencies above speech frequencies are attenuated with respect to speech frequencies;

a speech expander operatively coupled to said aural filter to produce an expanded voice signal, said speech expander configured to amplify said filter output signal according to an amplifier gain, wherein said amplifier gain is a function of an envelope amplitude of said filter output signal; and a combiner configured to combine at least a portion of said expanded voice signal and at least a portion of said voice signal to produce an enhanced voice signal;

wherein said voice enhancer is configured to provide a transfer function that approximates an inverse of loudness contours for human hearing;

wherein said speech expander comprises a gain controlled amplifier; and wherein the amplifier gain increases according to an attack time constant when said envelope amplitude has a positive slope and said amplifier gain decreases according to a decay time constant when said envelope amplitude has a negative slope.

5. A communication device configured to receive voice information from a communication sender, comprising:

a communication receiver configured to receive voice information comprising words spoken by a person from a communication channel; and a voice enhancer operably connected to said communication receiver, said voice enhancer comprising:

an aural filter configured to filter an input signal to produce a filtered signal;

an expander comprising an amplifier configured to amplify said filtered signal to produce an amplified signal, wherein a gain of said amplifier is a function of an amplitude envelope of said filtered signal; and a combiner configured to combine at least a portion of said amplified signal and at least a portion of said input signal to produce an output signal;

wherein said voice enhancer enhances formants of the voice information to increase intelligibility of the voice information; and wherein said voice enhancer provides a transfer function that approximates a complement of Fletcher-Munson curves for tones in a frontal sound field for humans.

6. The communication device of claim 5, wherein said communication device is a cordless telephone comprising a handset and a base unit.

7. The communication device of claim 5, wherein said communication device is a cellular telephone.

8. The communication device of claim 5, wherein said aural filter attenuates low and high frequencies with respect to middle frequencies.

9. The communication device of claim 5, wherein said combiner adds at least a portion of said amplified signal to said input signal.

10. The communication device of claim 5, further comprising a user control, said user control configured to enable and disable said voice enhancer.

11. The communication device of claim 5, further comprising a user control, said user control configured to vary an amount of enhancement produced by said voice enhancer.

12. The communication device of claim 5, wherein said voice enhancer is configured to approximate an inverse of loudness contours of human hearing.

13. An apparatus, comprising:

an aural filter configured to filter an input signal comprising words spoken by a person to produce a filtered signal;

an expander comprising an amplifier configured to amplify said filtered signal to produce an amplified signal, wherein a gain of said amplifier depends in part on an envelope of said filtered signal; and a combiner configured to combine at least a portion of said amplified signal and at least a portion of said input signal to produce an output signal;

wherein said apparatus is configured to provide a transfer function that emphasizes middle speech frequencies over low and high frequencies at high volume levels and is flatter at low volume levels.

14. The apparatus of claim 13, wherein said aural filter attenuates low and high frequencies with respect to middle frequencies.

15. The apparatus of claim 13, wherein said combiner adds at least a portion of said amplified signal to said input signal.

16. The apparatus of claim 13, wherein a gain of said amplifier depends in part upon a property of said filtered signal.

17. The apparatus of claim 13, wherein said aural filter attenuates low frequencies with respect to middle frequencies.

18. The apparatus of claim 13, wherein a gain of said amplifier increases according to an attack time constant.

19. The apparatus of claim 13, wherein a gain of said amplifier decreases according to a decay time constant.

20. The apparatus of claim 13, wherein said aural filter attenuates low frequencies and high frequencies with respect to middle frequencies.

21. The apparatus of claim 13, operably connected to a recording device.

22. The apparatus of claim 13, said apparatus incorporated into a telephone and adapted to improve intelligibility of voice information processed by said telephone.

23. The apparatus of claim 13, said apparatus incorporated into a hearing aid and adapted to improve intelligibility of voice information processed by said hearing aid.

24. The apparatus of claim 13, said apparatus incorporated into a public-address system and adapted to improve intelligibility of voice information processed by said public-address system.

25. The apparatus of claim 13, said apparatus incorporated into a communication system and adapted to improve intelligibility of voice information processed by said communication system.

26. The apparatus of claim 13, wherein said aural filter is an analog filter.

27. The apparatus of claim 13, wherein said aural filter is a digital filter.

28. A method for enhancing intelligibility of voice information, comprising the steps of:

filtering at least a portion of a first signal that includes human voice sounds to produce a filtered signal having an amplitude envelope;

expanding at least a portion of said filtered signal using an amplifier having a variable gain to produce an enhanced signal;

detecting the amplitude envelope to produce a gain control signal to control the gain of the amplifier; and combining at least a portion of said first signal with said enhanced signal to produce an improved signal;

wherein the method emphasizes middle speech frequencies over low and high frequencies at high volume levels and is flatter at low volume levels, such that the method provides a transfer function which approximates an inverse of loudness contours for human hearing.

29. The method of claim 28, wherein said step of combining comprises adding at least a portion of said first signal to said enhanced signal.

30. The method of claim 28, wherein said variable gain is a function of at least a portion of said filtered signal.

31. The method of claim 28, wherein said variable gain is a function of at least a portion of an envelope of said filtered signal.

32. The method of claim 28, wherein said variable gain is a function of at least a portion of an average power of said filtered signal.

33. The method of claim 28, wherein said variable gain is a function of at least a portion of a square-root of the mean of the squares average of said filtered signal.

34. The method of claim 28, wherein said variable gain depends upon at least a portion of an average peak value of said filtered signal.

35. The method of claim 28, wherein said variable gain depends upon at least a portion of said first signal.

36. The method of claim 28, further comprising the step of providing said enhanced signal to a loudspeaker system to be projected as sound into an area of ambient noise.

37. The method of claim 28, further comprising the step of providing said enhanced signal to a recording device.

38. The method of claim 28, wherein said variable gain increases according to an attack time constant.

39. The method of claim 38, wherein said variable gain decreases according to a decay time constant.

40. The method of claim 39, wherein said attack time constant is shorter than said decay time constant.

41. The method of claim 28, wherein said step of filtering comprises filtering said first signal using an aural filter.

42. The method of claim 41, wherein said aural filter comprises a bandpass filter.

43. The method of claim 41, wherein said aural filter attenuates low frequencies and high frequencies with respect to middle frequencies.

44. The method of claim 41, wherein said first signal comprises noise components and voice components, and wherein said aural filter combined with said speech expander reduces the degradation of said voice components by said noise components.

45. An apparatus for enhancing intelligibility of voice information, said apparatus comprising:

aural filter means for filtering an input signal to produce a filtered signal, said input signal containing human voice information;

gain controlled amplifier means for amplifying the filtered signal to produce an expanded signal;

gain control means for controlling a gain of the gain controlled amplifier as a function of an envelope amplitude of the filtered signal;

attack time means for increasing the gain for an attack time when a slope of the envelope amplitude is positive;

decay time means for decreasing the gain for a decay time when the slope of the envelope amplitude is negative; and combiner means for combining at least a portion of said expanded signal with at least a portion of said input signal;

wherein said apparatus is configured to provide a transfer function that emphasizes middle speech frequencies over low and high frequencies at high volume levels and is flatter at low volume levels, such that said transfer function approximates an inverse of loudness contours for human hearing of tones in a sound field.

46. An apparatus, comprising:

an input configured to receive an input signal comprising words spoken by a person; and a dynamic filter configured to filter said input signal to produce an enhanced signal with modified voice components, said dynamic filter configured to provide a transfer function that depends at least in part on an envelope of the input signal, wherein said transfer function emphasizes middle speech frequencies over low and high frequencies at high volume levels and is flatter at low volume levels.

47. The apparatus of claim 46, wherein said dynamic filter comprises a bandpass filter and an expander.

48. The apparatus of claim 46, wherein said dynamic filter comprises an aural filter.

49. The apparatus of claim 46, wherein said dynamic filter comprises a filter that attenuates low and high frequencies relative to middle frequencies.

50. The apparatus of claim 46, wherein said dynamic filter comprises an expander.

51. The apparatus of claim 46, further comprising a combiner configured to combine at least a portion of said input signal with at least a portion of said enhanced signal.

52. The apparatus of claim 46, further comprising a user control, said control configured to allow a user to adjust a transfer function of said dynamic filter.

53. A method of improving the intelligibility of voice sounds contained within a signal source when the signal source is reproduced through a loudspeaker, said method comprising the following steps:

detecting an envelope of a signal source comprising words spoken by a person to produce a control signal;

filtering the signal source according to a frequency response related to human hearing characteristics to produce a filtered signal;

modifying the frequency response used to filter said signal source wherein the amount of modification is a function of the control signal; and combining the signal source with the filtered signal to produce an output signal having enhanced voice sounds;

wherein, when the first signal is operating a high volume levels, the method emphasizes middle speech frequencies over low and high frequencies; and wherein, when the first signal is operating at low volume levels, the method provides more low and high frequency components of the first signal than when the first signal is operating a high volume levels;

such that the method provides a transfer function which approximates an inverse of loudness contours for human hearing.

54. The method of claim 53, wherein said step of modifying the frequency response comprises the step of increasing the gain of said frequency response in response to an increase in the amplitude level of voice sounds within said signal source.

55. The method of claim 53, wherein said signal source is part of a composite multi-channel audio signal and said signal source contains voice sounds mixed with noise.

56. A method of emphasizing human speech sounds contained within a signal source to produce an output signal comprises the following steps:

bandpass filtering said signal source to produce a filtered signal wherein said filtered signal includes speech frequencies and attenuates frequencies below and above speech frequencies;

analyzing at least a portion of said filtered signal to produce a control signal wherein said control signal represents a slope of an amplitude envelope of said filtered signal;

amplifying said filtered signal during a first amplification period to provide an enhancement signal wherein the level of amplification of said filtered signal is increased when the slope is positive;

amplifying said filtered signal during a second amplification period to provide an enhancement signal wherein the level of amplification of said filtered signal is decreased when the slope is negative; and combining said enhancement signal with said signal source to produce an output signal;

wherein said method provides a transfer function that emphasizes middle speech frequencies over low and high frequencies at high volume levels and is flatter at low volume levels, such that said transfer function approximates an inverse of loudness contours for human hearing of tones in a sound field.

57. The method of claim 56, wherein said second amplification period is a function of a predetermined decay time constant.

58. The method of claim 56, wherein said signal source is part of a composite signal representing voice and ambient information for presentation to a listener.

59. A voice enhancement device for enhancing intelligibility of a voice signal comprising:

a filter configured to receive a voice input signal, the filter configured to attenuate low frequencies below speech frequencies and high frequencies above speech frequencies with respect to speech frequencies to produce a filtered signal;

an envelope detector configured to receive at least a portion of the filtered signal, the envelope detector configured to detect an envelope amplitude of the filtered signal to produce an envelope signal, wherein the envelope signal approximates the envelope amplitude of the filtered signal;

an amplifier configured to receive the filtered signal, the amplifier having a gain control input for controlling a gain of the amplifier, the amplifier configured to amplify the filtered signal according to the gain to produce an amplified signal;

an attack/decay buffer comprising an attack time constant and a decay time constant configured to receive the envelope signal and to produce a gain control signal to control the gain of the amplifier, wherein the attack/decay buffer provides the gain control signal to the gain control input to increase the gain of the amplifier at a rate given by the attack time constant when the envelope signal has a positive slope and to decrease the gain of the amplifier at a rate given by the decay time constant when the envelope signal has a negative slope; and a combiner configured to add at least a portion of the voice input signal with the amplified signal to produce an enhanced voice signal;

wherein said device is configured to provide a transfer function that approximates an inverse of loudness contours for human hearing of tones in a sound field.

60. The device of claim 59 further comprising a fixed gain amplifier configured to receive the voice input signal and to produce a fixed gain output signal, wherein the fixed gain output signal is combined with the amplified signal.

61. The device of claim 59 wherein the attack time constant is between approximately 1 ms to approximately 40 ms.

62. The device of claim 59 wherein the decay time constant is between approximately 10 ms to approximately 1000 ms.

* * * * *